US009367027B2

(12) United States Patent
Abe et al.

(10) Patent No.: US 9,367,027 B2
(45) Date of Patent: Jun. 14, 2016

(54) PHOTOSENSITIVE CARTRIDGE HAVING LIGHT GUIDE

(71) Applicant: BROTHER KOGYO KABUSHIKI KAISHA, Nagoya-shi, Aichi-ken (JP)

(72) Inventors: Koji Abe, Nagoya (JP); Masaki Yasuda, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/671,625

(22) Filed: Mar. 27, 2015

(65) Prior Publication Data

US 2015/0277360 A1 Oct. 1, 2015

(30) Foreign Application Priority Data

Mar. 31, 2014 (JP) ..... 2014-071832
Jan. 6, 2015 (JP) ..... 2015-001001

(51) Int. Cl.

| | |
|---|---|
| ***G03G 21/00*** | (2006.01) |
| ***G03G 21/16*** | (2006.01) |
| ***G03G 21/06*** | (2006.01) |
| ***G03G 21/18*** | (2006.01) |
| ***G03G 21/08*** | (2006.01) |

(52) U.S. Cl.

CPC ..... *G03G 21/1671* (2013.01); *G03G 21/0094* (2013.01); *G03G 21/06* (2013.01); *G03G 21/08* (2013.01); *G03G 21/1814* (2013.01); *G03G 21/1817* (2013.01); *G03G 2221/1853* (2013.01)

(58) Field of Classification Search

CPC ... G03G 21/1671; G03G 21/06; G03G 21/08; G03G 21/0094; G03G 21/1814; G03G 21/1817; G03G 21/1666; G03G 2221/1853; G03G 2221/1636

See application file for complete search history.

(56) References Cited

U.S. PATENT DOCUMENTS

2002/0081126 A1* 6/2002 Yokomori ..... G03G 21/1814 399/118
2006/0060751 A1* 3/2006 Nishimura ..... G03G 21/08 250/208.1
2008/0193163 A1* 8/2008 Moon ..... G03G 21/08 399/128

(Continued)

FOREIGN PATENT DOCUMENTS

JP 1-88970 U 6/1989
JP 2002-189400 A 7/2002

(Continued)

OTHER PUBLICATIONS

U.S. Appl. No. 14/671,242, filed Mar. 27, 2015.

(Continued)

*Primary Examiner* — Ryan Walsh
(74) *Attorney, Agent, or Firm* — Merchant & Gould P.C.

(57) ABSTRACT

A photosensitive cartridge includes a photosensitive drum, and a guide member. The guide member is configured to guide light emitted from the light source toward a surface of the photosensitive drum to neutralize charge on the surface of the photosensitive drum. The guide member includes a first part, a second part, and a third part. The first part is configured to receive the light. The first part extends in a direction intersecting an axial direction of the photosensitive drum. The second part faces the photosensitive drum and extends in the axial direction. The third part connects the first part and the second part. The third part is configured to allow the light to pass through the first part toward the second part.

21 Claims, 12 Drawing Sheets

(56) References Cited

U.S. PATENT DOCUMENTS

| | | | | |
|---|---|---|---|---|
| 2009/0324287 | A1* | 12/2009 | Okabe | G03G 21/08 399/128 |
| 2010/0080623 | A1 | 4/2010 | Tanaka et al. | |
| 2010/0278571 | A1* | 11/2010 | Abe | G03G 21/0058 399/357 |
| 2011/0020034 | A1* | 1/2011 | Tsutsumi | G03G 21/08 399/128 |
| 2011/0129254 | A1* | 6/2011 | Oda | G03G 21/0094 399/128 |
| 2011/0243609 | A1 | 10/2011 | Takami et al. | |
| 2012/0201561 | A1* | 8/2012 | Kubo | G03G 21/06 399/89 |
| 2013/0195488 | A1* | 8/2013 | Hatano | G03G 15/0189 399/66 |
| 2015/0023696 | A1* | 1/2015 | Hayashi | G03G 21/0005 399/128 |
| 2015/0030351 | A1* | 1/2015 | Wakayama | G03G 21/08 399/128 |
| 2015/0277359 | A1 | 10/2015 | Abe et al. | |
| 2015/0277360 | A1* | 10/2015 | Abe | G03G 21/1671 399/128 |

FOREIGN PATENT DOCUMENTS

| | | | | |
|---|---|---|---|---|
| JP | 2002278395 | A | * | 9/2002 |
| JP | 2005-275130 | A | | 10/2005 |
| JP | 2006-91332 | A | | 4/2006 |
| JP | 2006154619 | A | * | 6/2006 |
| JP | 2006276529 | A | * | 10/2006 |
| JP | 2009-243629 | A | | 10/2009 |
| JP | 2011-64711 | | | 3/2011 |
| JP | 2011-227425 | A | | 11/2011 |

OTHER PUBLICATIONS

Office Action issued in related U.S. Appl. No. 14/671,242, Mar. 30, 2016.

* cited by examiner

PHOTOSENSITIVE CARTRIDGE HAVING LIGHT GUIDE

CROSS REFERENCE TO RELATED APPLICATION

This application claims priority from Japanese Patent Application No. 2014-071832 filed Mar. 31, 2014 and Japanese Patent Application No. 2015-001001 filed Jan. 6, 2015. The entire contents of these priority applications are incorporated herein by reference.

TECHNICAL FIELD

The present disclosure relates to a photosensitive cartridge configured to be removably mounted in an image forming device employing an electrophotographic system.

BACKGROUND

One electrophotographic image forming device is known as a printer that includes a device body; a drum unit having a photosensitive drum and a charger and removably mounted in the device body; a developing cartridge mounted in the drum unit and having a developing roller; and an exposure device for exposing the photosensitive drum.

In this type of the printer, the charger first applies charge to the surface of the photosensitive drum, after which the exposure device selectively removes charge from the surface of the photosensitive drum to form an electrostatic latent image thereon. The developing roller supplies toner to the electrostatic latent image on the photosensitive drum to form a toner image thereon. The toner image is then transferred from the surface of the photosensitive drum onto paper to form an image on the paper.

SUMMARY

However, occasionally electric charge remains on the surface of the photosensitive drum after a toner image has been transferred from the photosensitive drum to a paper, which affects the subsequent electrostatic latent image formed on the surface of the photosensitive drum, degrading image formation quality.

One printer includes a rod-like light guide supported in the drum unit, facing the surface of the photosensitive drum, and extending in the left-right direction, and a light source disposed rightward of the light guide in the device body.

In this printer having this construction, light emitted from the light source enters the light guide through the right endface of the light guide and then is guided by the light guide to be irradiated onto the surface of the photosensitive drum. This light removes any residual charge from the surface of the photosensitive drum.

However, the light emitted from the light source enters the light guide through the right endface thereof in the printer described above. Therefore, the light source needs to be arranged immediately rightward of the light guide in the left-right direction. This configuration makes it difficult to reduce the size of the printer in the left-right direction.

In view of the foregoing, it is an object of the present disclosure to provide a photosensitive cartridge having a construction that enables an image-forming device to be made more compact in the axial direction of the photosensitive drum.

In order to attain the above and other objects, the present disclosure provides an image forming device. The photosensitive cartridge may be removably mounted in an image forming device having a light source. The photosensitive cartridge may include a photosensitive drum and a guide member. The photosensitive drum may have a surface on which an electrostatic latent image is configured to be formed. The photosensitive drum may extend in an axial direction. The guide member may be configured to guide light emitted from the light source toward the surface of the photosensitive drum to neutralize charge on the surface of the photosensitive drum. The guide member may include a first part, a second part and a third part. The first part may be configured to receive the light emitted from the light source. The first part may extend in a direction crossing the axial direction. The second part may face the photosensitive drum and extend in the axial direction. The third part may be connect the first part and the second part and configured to allow the light to pass through the first part toward the second part.

DETAILED DESCRIPTION

1. Detailed Description of the Drum Cartridge

Figure 1:
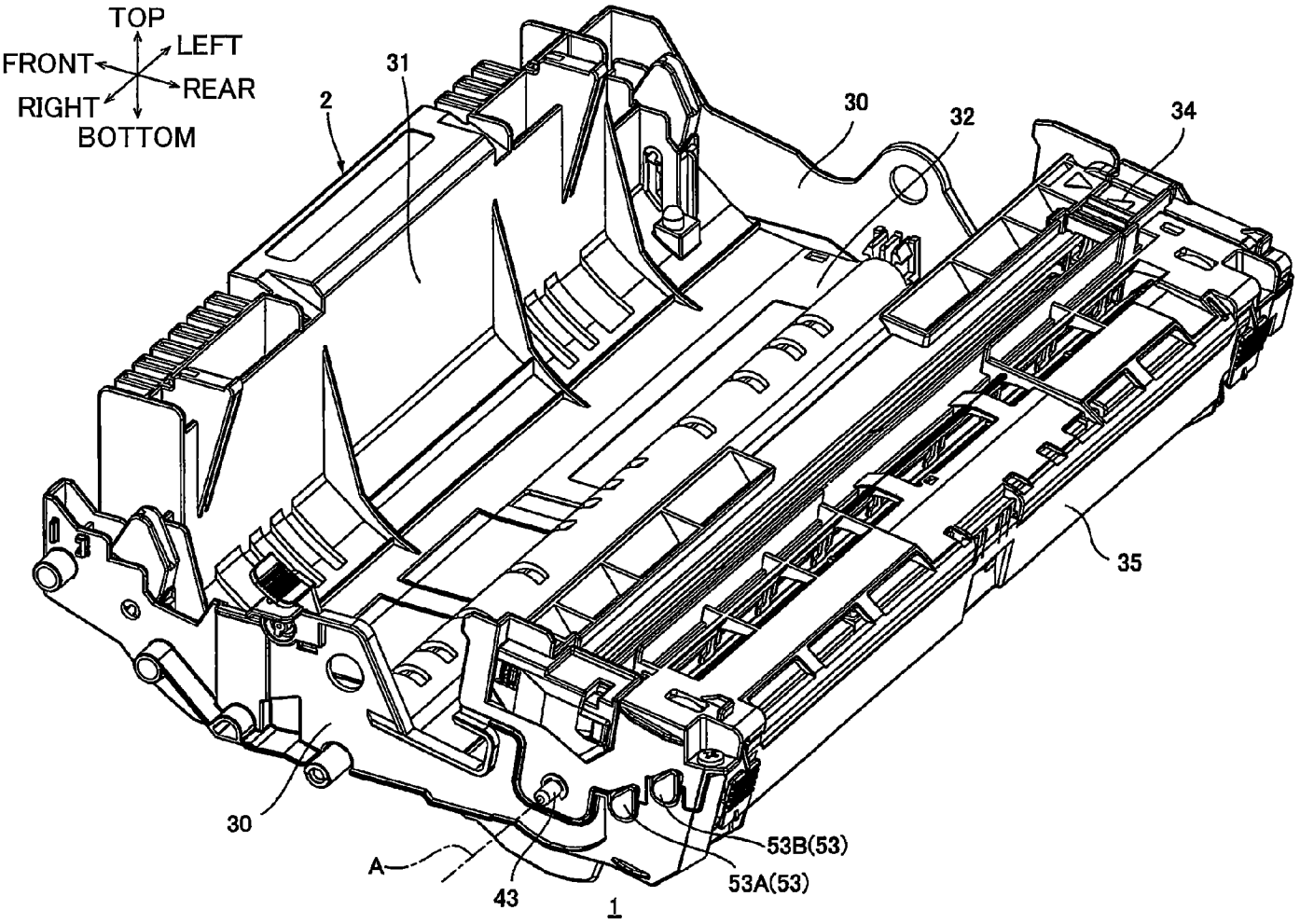
FIG. 1 is a perspective view of a drum cartridge according to a first embodiment of the present disclosure.
Figure 2:
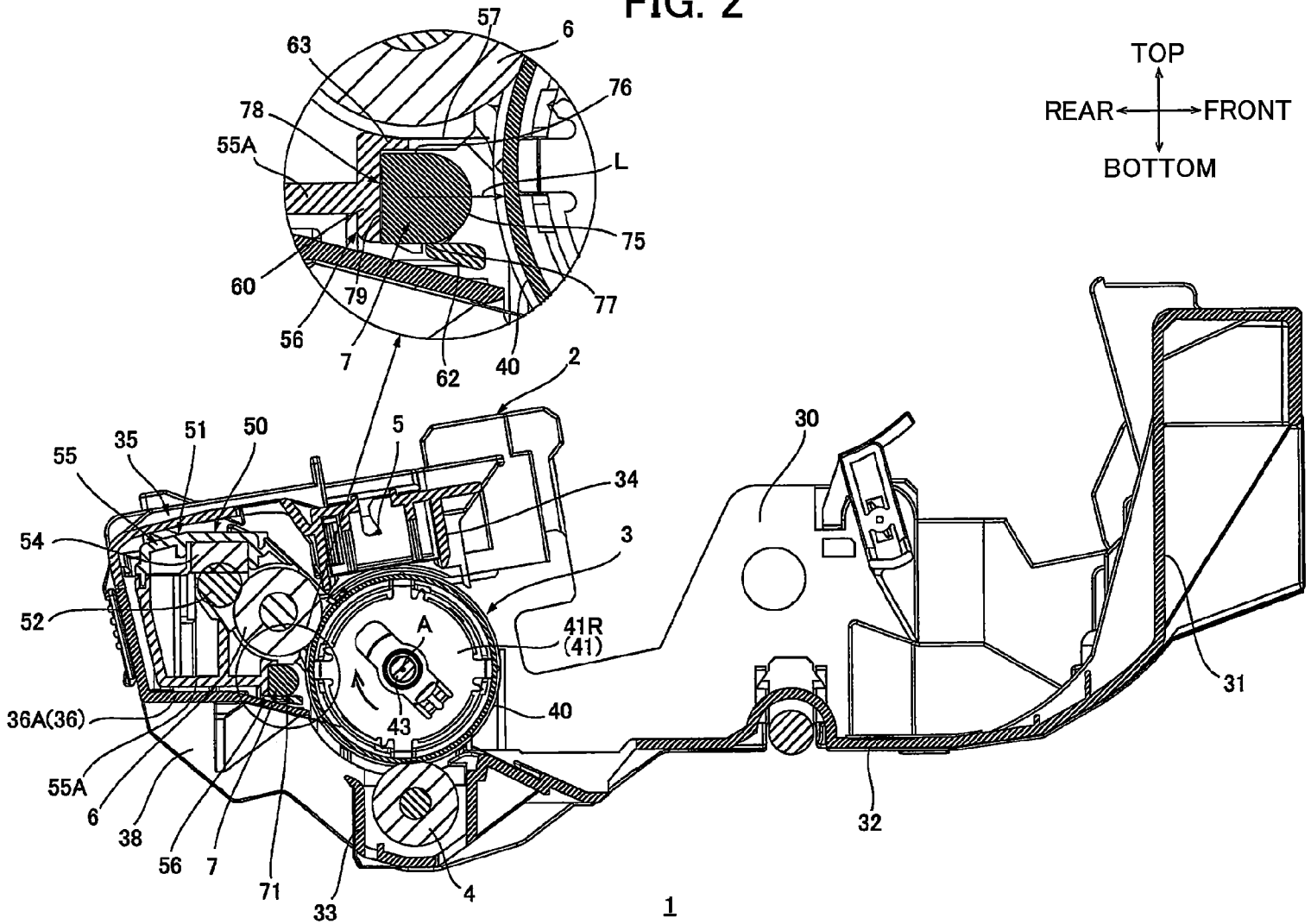
FIG. 2 is a central cross-sectional view of the drum cartridge according to the first embodiment.

As shown in FIGS. 1 and 2, a drum cartridge 1 as an example of the photosensitive cartridge includes a drum frame 2, a photosensitive drum 3, a transfer roller 4, a scorotron charger 5, a cleaning unit 50, and a light guide 7 as an example of the guide member.

When giving directions related to the drum cartridge 1 in the following description, the side of the drum cartridge 1 in which the photosensitive drum 3 is provided will be called the "rear," while the opposite side of the drum cartridge 1 will be called the "front." Left and right sides of the drum cartridge 1 will be defined based on the perspective of a user facing the front of the drum cartridge 1. Directional arrows have also been provided in the drawings for reference.

Further, the left-right direction is an example of the axial direction. The top-bottom direction is an example of the orthogonal direction.

As shown in FIG. 1, the drum frame 2 has a frame-like structure having a closed bottom and is of generally rectangular shape in a plan view.

As shown in FIG. 2, the photosensitive drum 3 is rotatably supported on the rear portion of the drum frame 2. The transfer roller 4 is disposed beneath the photosensitive drum 3 and has the top surface in rolling contact with the bottom surface of the photosensitive drum 3. The scorotron charger 5 is disposed above the photosensitive drum 3 with a gap therebetween.

The cleaning unit 50 is disposed rearward of the photosensitive drum 3. The cleaning unit 50 is provided with a cleaning roller 6 as an example of the cleaning member.

The cleaning roller 6 is disposed at the front section of the cleaning unit 50 and configured to remove extraneous matter deposited on the surface of the photosensitive drum 3. The lower front surface of the cleaning roller 6 is in rolling contact with the upper rear surface of the photosensitive drum 3.

Figure 7A:
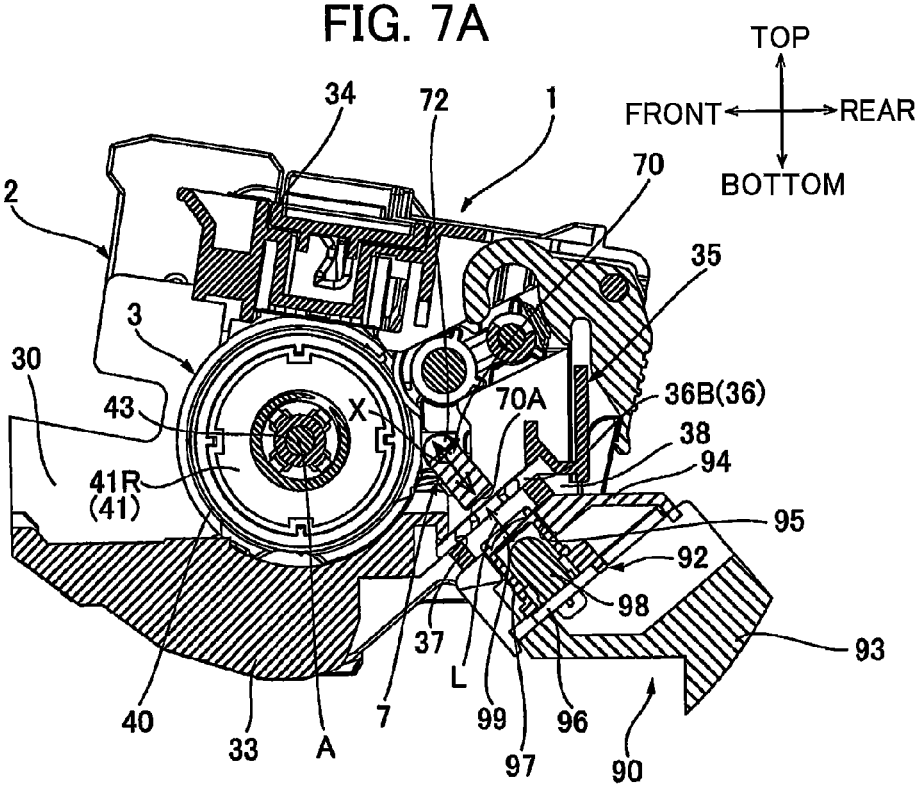
FIG. 7A is a cross-sectional view of the drum cartridge taken along a line VII-VII of FIG. 6 according to the first embodiment.

The light guide 7 is configured to guide light L emitted from a light source 90 described later toward the surface of the photosensitive drum 3, as shown in FIG. 7A. The light L emitted from the light source 90 is configured to neutralize charge on the surface of the photosensitive drum 3. The light guide 7 is disposed beneath the cleaning roller 6 and rearward of the photosensitive drum 3 and is spaced away from the photosensitive drum 3.

2. Using State of the Drum Cartridge (1) Overview of a Printer

Figure 3:
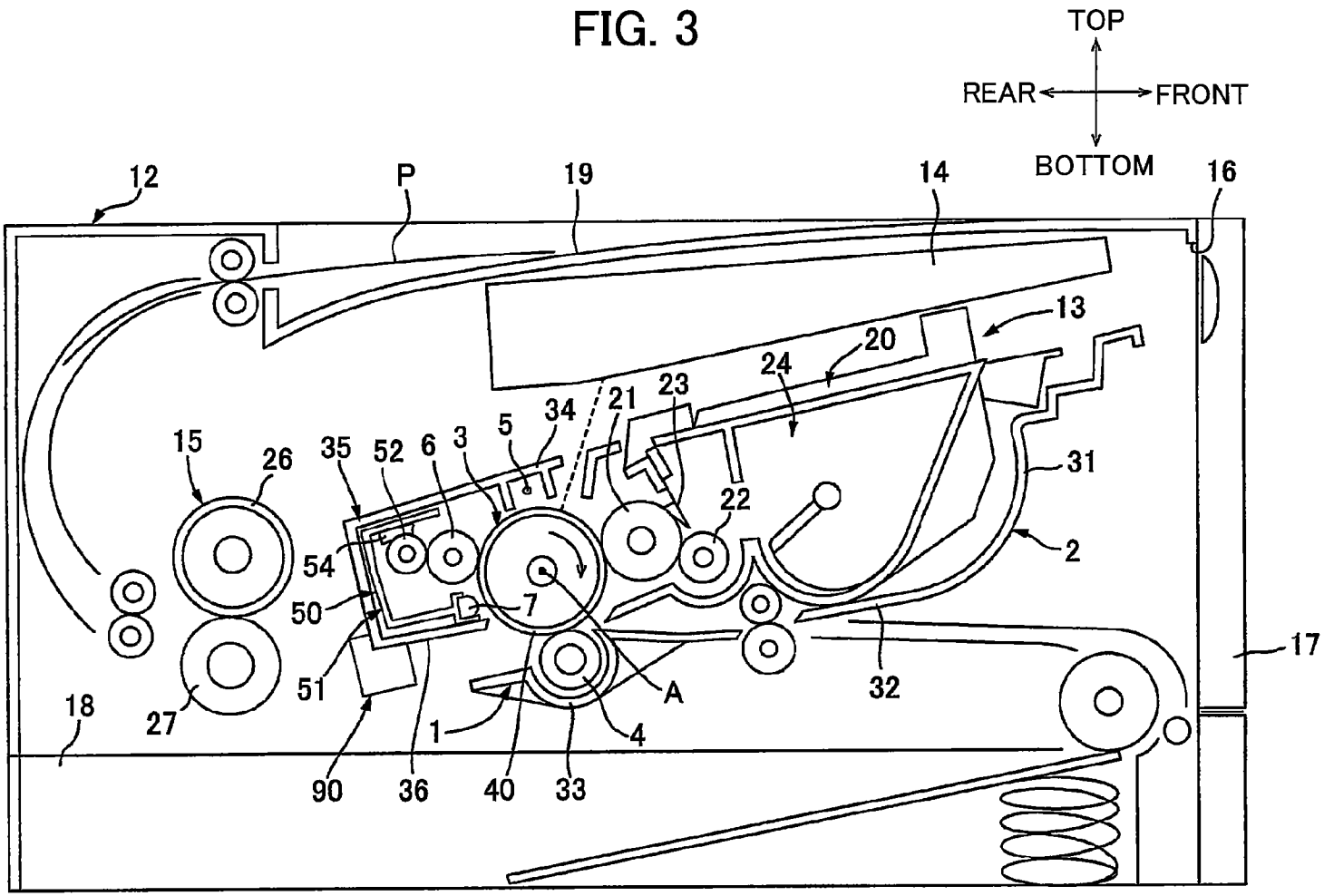
FIG. 3 is a schematic cross-sectional view of a printer in which the drum cartridge is mounted according to the first embodiment.

As shown in FIG. 3, the drum cartridge 1 is used when mounted in a printer 11 as an example of the image forming device.

The printer 11 according to the first embodiment is a monochromatic printer having an electrophotographic system. The printer 11 includes a device body 12, a process cartridge 13, a scanning unit 14, and a fixing unit 15.

The device body 12 has a box-like shape. The device body 12 includes an access opening 16, a front cover 17, a paper tray 18, and a discharge tray 19.

The access opening 16 is formed at the front end of the device body 12. The access opening 16 provides communication between the interior and the exterior of the device body 12 and allows the process cartridge 13 to pass therethrough.

The front cover 17 is provided on the front end of the device body 12. The front cover 17 has a general plate shape and extends vertically at a closed position. The front cover 17 is supported on the device body 12 and is pivotally movable about the bottom edge thereof. The front cover 17 can open and close the access opening 16.

The paper tray 18 is disposed at the bottom section of the device body 12. The paper tray 18 has a box-like shape with the top portion opened and is configured to accommodate therein sheets P.

The discharge tray 19 is disposed at the approximate front-rear center on the top surface of the device body 12. The discharge tray 19 is recessed downward from the top surface of the device body 12 in order to receive or to support sheets P.

The process cartridge 13 is configured to be mounted in and removed from the device body 12 through the access opening 16. When mounted in the device body 12, the process cartridge 13 is disposed at the approximate center of the device body 12 in a side view. The process cartridge 13 includes the drum cartridge 1, and a developing cartridge 20.

The developing cartridge 20 is configured to be mounted in and removed from the drum cartridge 1. When mounted in the drum cartridge 1, the developing cartridge 20 is positioned at the front side of the photosensitive drum 3. The developing cartridge 20 includes a developing roller 21, a supply roller 22, a thickness-regulating blade 23, and a toner-accommodating section 24.

The developing roller 21 is rotatably supported on the rear portion of the developing cartridge 20. The developing roller 21 has a general columnar shape whose axis extends in the left-right direction. The rear surface of the developing roller 21 is in rolling contact with the front surface of the photosensitive drum 3.

The supply roller 22 is disposed at diagonally lower front side of the developing roller 21. The supply roller 22 has a general columnar shape and is rotatably supported on the developing cartridge 20 with the axis extending in the left-right direction. The upper rear surface of the supply roller 22 is in rolling contact with the lower front surface of the developing roller 21.

The thickness-regulating blade 23 is disposed at diagonally upward and frontward of the developing roller 21. The thickness-regulating blade 23 is in sliding contact with the front surface of the developing roller 21.

The toner-accommodating section 24 is formed in the developing cartridge 20 at the front side of the supply roller 22 and the thickness-regulating blade 23. The toner-accommodating section 24 is configured to accommodate therein toner.

The scanning unit 14 is disposed above the process cartridge 13 in the device body 12. The scanning unit 14 is configured to irradiate a laser beam toward the photosensitive drum 3 based on image data.

The fixing unit 15 is disposed rearward of the process cartridge 13 in the device body 12. The fixing unit 15 includes a heating roller 26, and a pressure roller 27. The pressure roller 27 is positioned below the heating roller 26 such that the top surface of the pressure roller 27 is in pressure contact with the bottom surface of the heating roller 26.

(2) Image Forming Operation

The printer 11 performs image-forming operations under control of a control unit (not shown). At the beginning of the image-forming operation, the scorotron charger 5 applies a uniform charge to the surface of the photosensitive drum 3. Next, the scanning unit 14 exposes the surface of the photosensitive drum 3, forming an electrostatic latent image on an image forming region T1 (described later) on the surface of the photosensitive drum 3 based on image data.

The supply roller 22 supplies toner from the toner-accommodating section 24 to the developing roller 21. At this time, the toner is positively tribocharged between the developing roller 21 and the supply roller 22, so that the developing roller 21 carries charged toner thereon. The thickness-regulating blade 23 regulates the toner carried on the surface of the developing roller 21 in a uniform thickness.

The toner carried on the developing roller 21 is then supplied to the electrostatic latent image formed on the surface of the photosensitive drum 3. As a result, the photosensitive drum 3 carries a toner image on the surface thereof.

In the meantime, various rollers in the printer 11 rotate to feed the sheet P from the paper tray 18 and to supply the sheet P one at a time and at a prescribed timing to a position between the photosensitive drum 3 and the transfer roller 4.

When the sheet P passes between the photosensitive drum 3 and the transfer roller 4, the toner image carried on the surface of the photosensitive drum 3 is transferred onto the sheet P.

When the sheet P passes through the fixing unit 15, the heating roller 26 and the pressure roller 27 apply heat and pressure to the sheet P, thermally fixing the toner image to the sheet P. Subsequently, various rollers in the printer 11 rotate to discharge the sheet P on the discharge tray 19.

3. Detailed Description of the Drum Cartridge (1) Drum Frame

Figure 6:
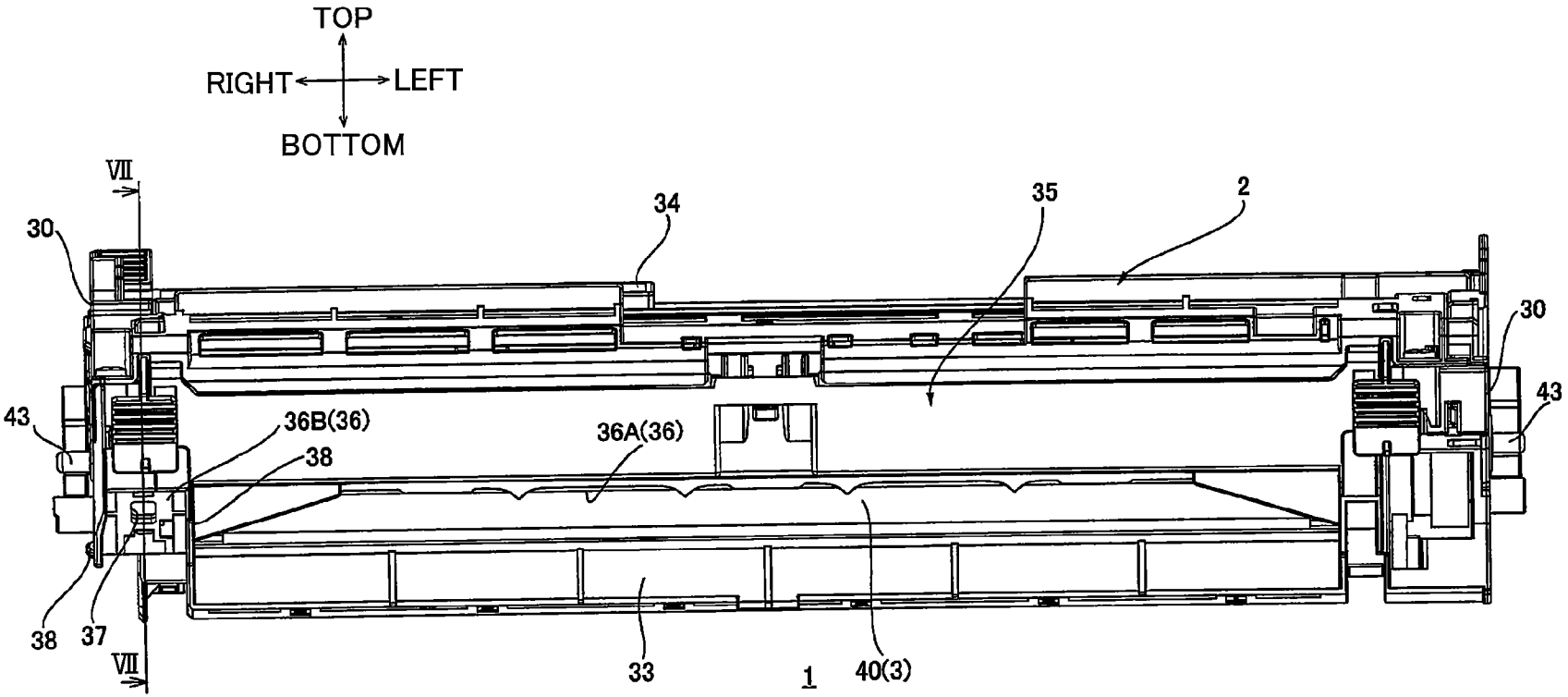
FIG. 6 is a rear view of the drum cartridge according to the first embodiment.

As shown in FIGS. 1, 2, and 6, the drum frame 2 includes a pair of right and left side frame walls 30, a front frame wall 31, a bottom frame wall 32, a transfer roller accommodating section 33, a charger accommodating section 34, a cleaner accommodating section 35, and a pair of ribs 38.

As shown in FIG. 1, the side frame walls 30 constitute the left and right ends of the drum frame 2 and are aligned with but separated from each other in the left-right direction. Each of the side frame walls 30 has a plate shape that is generally rectangular in a side view and elongated in the front-rear direction.

Figure 7B:
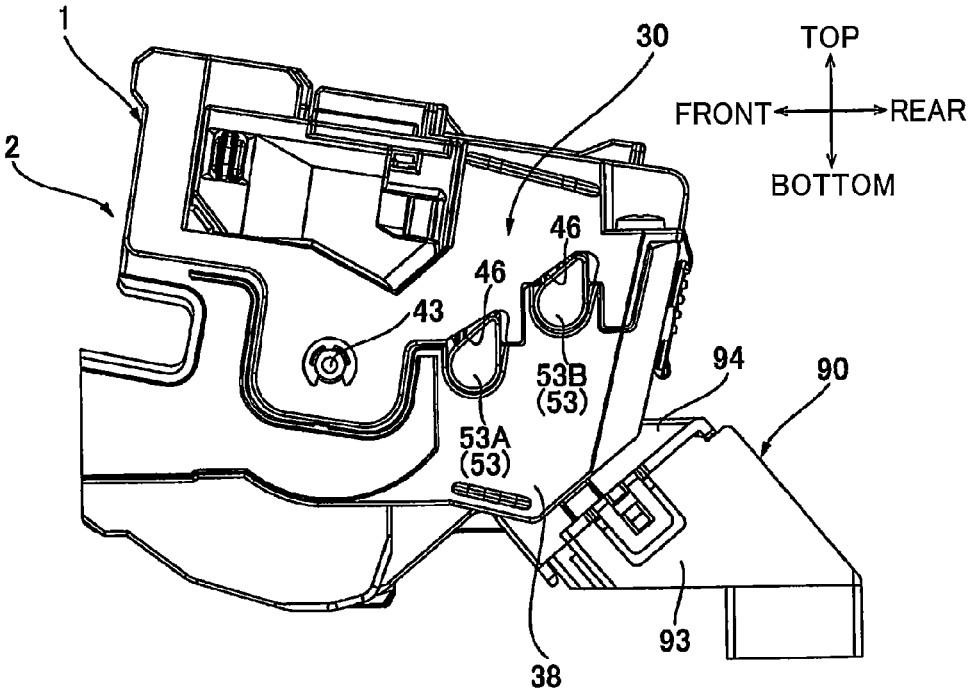
FIG. 7B is a right side view of the drum cartridge and a light source according to the first embodiment.

As shown in FIG. 7B, the right side frame wall 30 is formed with two electrode-exposing holes 46. The electrode-exposing holes 46 are arranged at the rear portion of the right side frame wall 30 and are separated from each other in a direction diagonally extending from the lower front to the upper rear. The electrode-exposing holes 46 have a general teardrop shape in a side view becoming narrow toward the top, and penetrate the right side frame wall 30 in the left-right direction.

As shown in FIG. 2, the front frame wall 31 constitutes the front side of the drum frame 2 and spans the front ends of the side frame walls 30. The bottom frame wall 32 constitutes the bottom side of the drum frame 2 and spans the front portions of the bottom edges of the side frame walls 30. The front edge of the bottom frame wall 32 is connected to the bottom edge of the front frame wall 31.

The transfer roller accommodating section 33 is positioned rearward of the bottom frame wall 32 and is separated therefrom. The transfer roller accommodating section 33 has a general U-shape in a side view, with the opening of the "U" facing upward, and is elongated in the left-right direction. The left and right ends of the transfer roller accommodating section 33 are respectively connected to the lower rear portion of the left and right side frame walls 30.

The charger accommodating section 34 is positioned above the transfer roller accommodating section 33 and is separated therefrom. The charger accommodating section 34 has a general U-shape in a side view, with the opening of the "U" facing downward and is elongated in the left-right direction. The left and right ends of the charger accommodating section 34 are respectively connected to the upper rear portion of the left and right side frame walls 30.

The cleaner accommodating section 35 is disposed at the rear end of the drum frame 2, i.e., at diagonally lower rear of the charger accommodating section 34. The cleaner accommodating section 35 has a general U-shape in a side view with the opening of the "U" facing forward, and is elongated in the left-right direction. The left and right ends of the cleaner accommodating section 35 are respectively connected to the rear ends of the side frame walls 30.

As shown in FIGS. 2 and 6, the cleaner accommodating section 35 has an accommodating section bottom wall 36. The accommodating section bottom wall 36 has a general plate shape elongated in the left-right direction and constitutes the bottom of the cleaner accommodating section 35. More specifically, the accommodating section bottom wall 36 is integrally provided with a flat section 36A, and a sloped section 36B.

The flat section 36A extends in the front-rear direction and constitutes the portion of the accommodating section bottom wall 36 other than the right end portion thereof.

The sloped section 36B constitutes the right end portion of the accommodating section bottom wall 36 and extends in a direction diagonally from the lower front to the upper rear, as shown in FIG. 7A. The right edge of the sloped section 36B is connected to the lower rear edge of the right side frame wall 30, as shown in FIG. 6. The sloped section 36B is formed with an opening 37.

As shown in FIGS. 6 and 7A, the opening 37 is formed in the approximate center region of the sloped section 36B. The opening 37 has a general rectangular shape as viewed from the lower rear side and penetrates the sloped section 36B in a direction from the upper front to the lower rear.

As shown in FIG. 6, the ribs 38 are provided at the right end portion of the lower rear portion of the drum frame 2 so as to sandwich the opening 37 in the left-right direction with a gap therebetween. As shown in FIG. 7B, the ribs 38 have a plate shape that is generally rectangular in a side view. The right rib 38 is integrally formed with the right side frame wall 30, protruding continuously in a direction diagonally downward and rearward from the lower rear edge of the right side frame wall 30. The left rib 38 is positioned leftward of and spaced away from the right rib 38, as shown in FIG. 6. The left rib 38 protrudes in a direction diagonally downward and rearward from the bottom surface of the sloped section 36B.

(2) Photosensitive Drum, Transfer Roller, and Scorotron Charger

As shown in FIG. 2, the drum frame 2 supports the photosensitive drum 3, the transfer roller 4, the scorotron charger 5, and the cleaning unit 50 between the pair of side frame walls 30.

The photosensitive drum 3 is disposed between the transfer roller accommodating section 33 and the charger accommodating section 34 in the top-bottom direction and forward of the cleaner accommodating section 35. Through this arrangement, the photosensitive drum 3 is accommodated in the drum frame 2.

Figure 8:
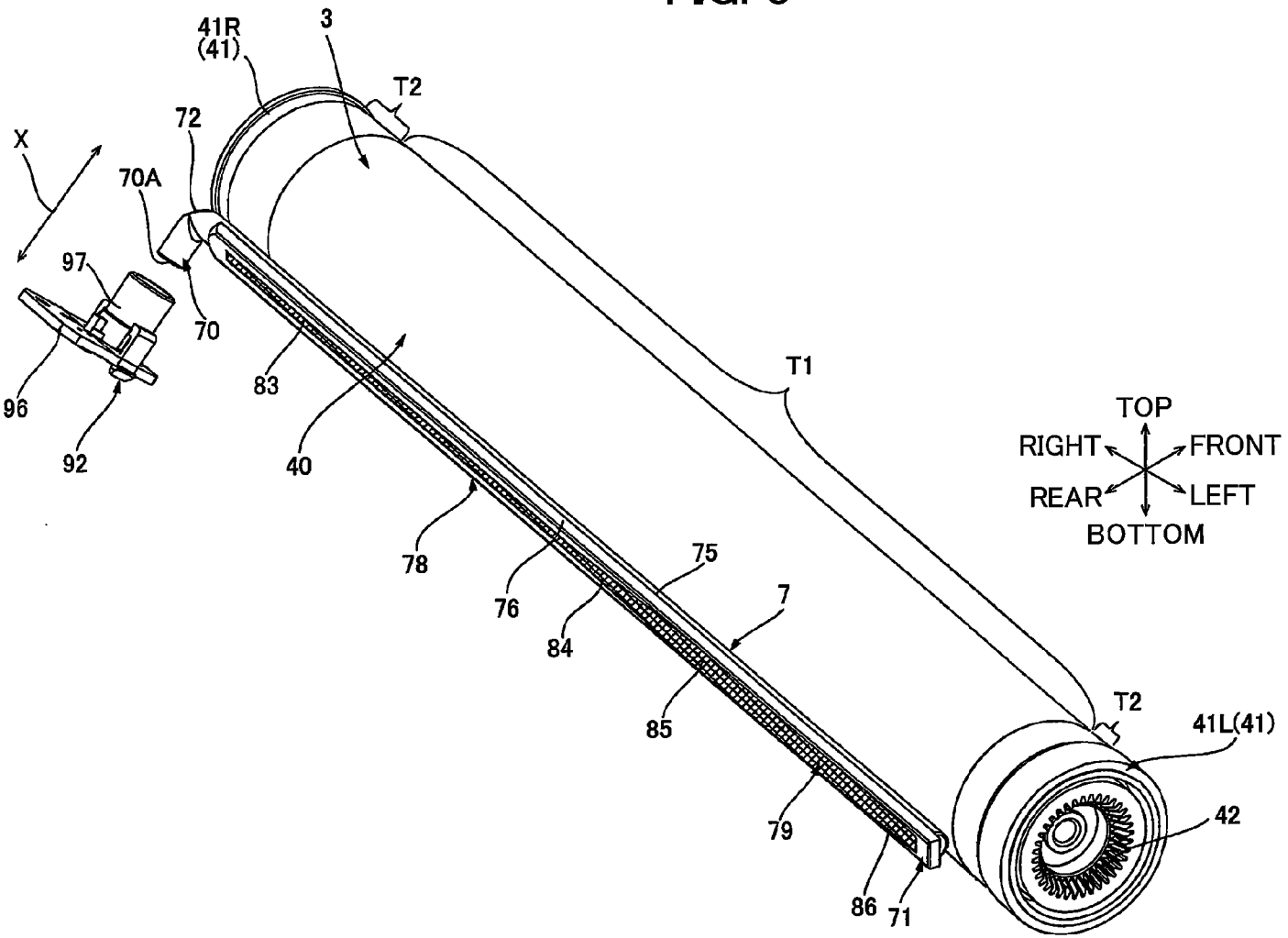
FIG. 8 is a perspective view of a photosensitive drum and the light guide as viewed from diagonally upper rear according to the first embodiment.

As shown in FIGS. 2 and 8, the photosensitive drum 3 includes a drum body 40, a pair of flange parts 41, and a drum shaft 43.

The drum body 40 includes a metal tube formed in a general cylindrical shape whose axis extends in the left-right direction, and a photosensitive layer coating the circumferential surface of the metal tube. The circumferential surface of the drum body 40 defines the image-forming region T1, and a pair of non-image-forming regions T2.

The non-image-forming regions T2 constitute the left and right end portions of the circumferential surface of the drum body 40, and the image-forming region T1 is the remaining portion of the circumferential surface of the drum body 40 between the non-image-forming regions T2 in the left-right direction. The image-forming region T1 is coated with a photosensitive layer having uniform thickness. The electrostatic latent image is formed on the image-forming region T1 during the image-forming operation described above.

Each flange part 41 has a general columnar shape whose axis extends in the left-right direction. The flange parts 41 are fitted into respective left and right ends of the drum body 40 so as to be unrotatable relative thereto.

More specifically, the flange parts 41 include a right flange part 41R fitted into the right end of the drum body 40 so as to be unrotatable relative thereto, and a left flange part 41L fitted into the left end of the drum body 40 so as to be unrotatable relative thereto. The left flange part 41L is formed with an engaging recess 42.

The engaging recess 42 is formed in the radial center region on the left surface of the left flange part 41L. The engaging recess 42 has a general circular shape in a side view and is recessed rightward from the left end of the left flange part 41L. Gear teeth are formed around the entire inner circumferential surface of the engaging recess 42. With this configuration, the left flange part 41L is configured to receive an external drive force inputted from a drive source (not shown) provided in the device body 12. That is, the left flange part 41L is configured to receive the drive force from outside of the drum cartridge 1. Thus, the left flange part 41L serves as an example of the drive receiving part and is disposed leftward (as an example of a second side) of the image-forming region T1.

As shown in FIGS. 1 and 2, the drum shaft 43 has a general columnar shape whose axis extends in the left-right direction. The left-right dimension of the drum shaft 43 is greater than the left-right dimension of the drum body 40. The drum shaft 43 is inserted through the drum body 40 so as to be coaxial with the drum body 40. The left and right ends of the drum shaft 43 penetrate the corresponding the flange parts 41 so as to be rotatable relative to the flange parts 41, and protrude further outward in the left-right direction than the flange parts 41.

The drum shaft 43 has a central axis A about which the drum body 40 of the photosensitive drum 3 can rotate. The left and right ends of the drum shaft 43 are supported on the rear portions of the corresponding side frame walls 30. In the image-forming operation described above, the drum body 40 receives an external drive force from the drive source (not shown) via the left flange part 41L. This drive force drives the drum body 40 to rotate clockwise in a left side view, as shown in FIGS. 2 and 3.

As shown in FIG. 2, the transfer roller 4 is accommodated in the transfer roller accommodating section 33. The transfer roller 4 has a general columnar shape whose axis extends in the left-right direction. The transfer roller 4 is supported on the drum frame 2 with the left and right ends rotatably supported in the corresponding side frame walls 30. The top surface of the transfer roller 4 is in rolling contact with the bottom surface of the drum body 40 in the drum frame 2.

The scorotron charger 5 is accommodated in and supported on the charger accommodating section 34. The scorotron charger 5 is disposed above the drum body 40 of the drum frame 2 with a gap therebetween.

(3) Cleaning Unit

The cleaning unit 50 is positioned rearward of the photosensitive drum 3 and is accommodated in the cleaner accommodating section 35.

Figure 4:
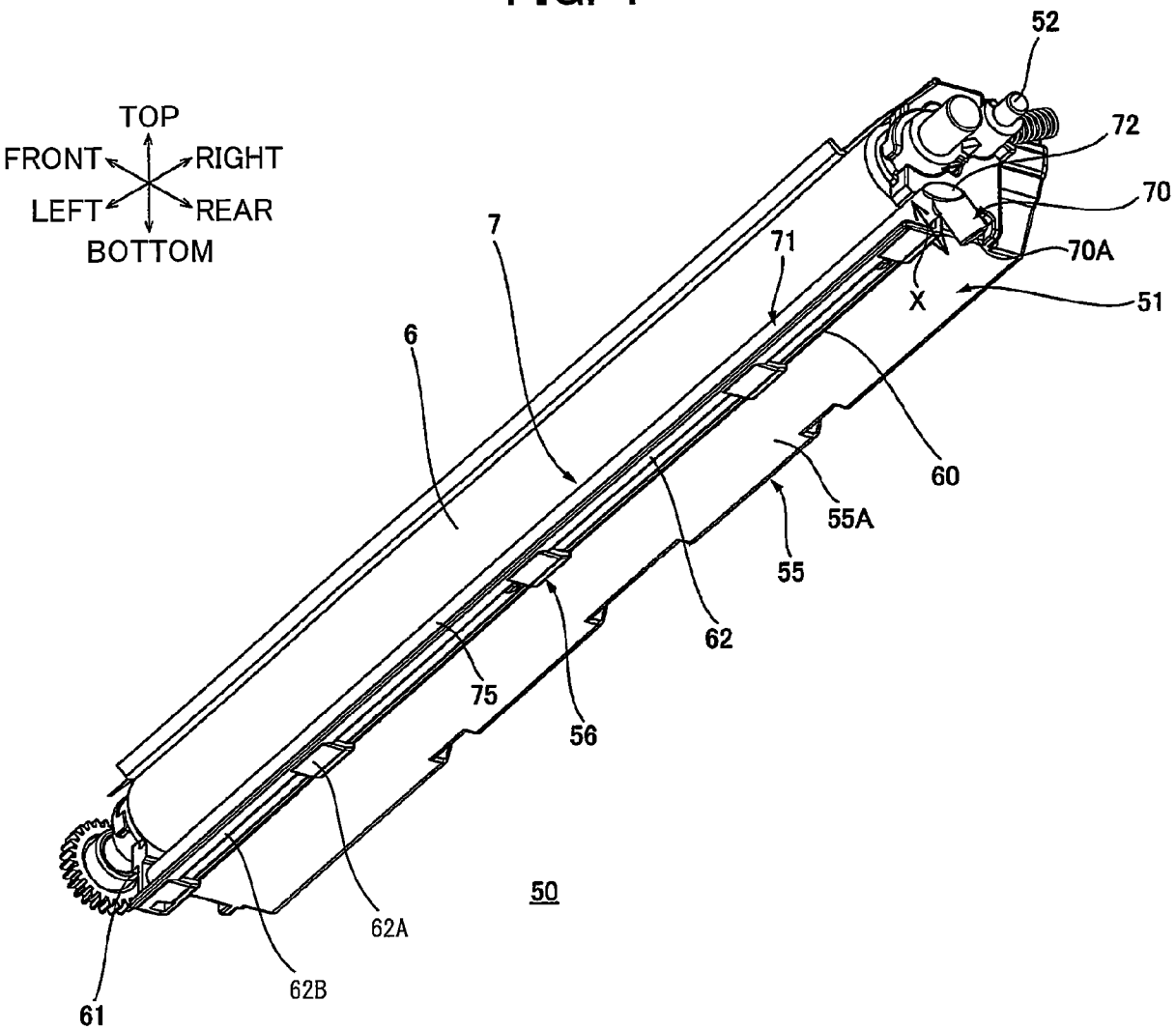
FIG. 4 is a perspective view of a cleaning unit and a light guide as viewed from diagonally lower front according to the first embodiment.

As shown in FIGS. 2, 4, and 7B, the cleaning unit 50 includes a cleaning roller 6, a cleaning frame 51, a collecting roller 52, a cleaning electrode 53 as an example of the electrode member, a sponge scraper 54, and a film member 57 as an example of the covering portion.

As shown in FIG. 2, the cleaning frame 51 is formed of a resin that is opaque and has a color configured to reflect light, i.e., white resin in the first embodiment. The cleaning frame 51 is integrally configured of a frame body 55, and a light-guide support part 56 as an example of the cover. That is, the light-guide support part 56 is a part of the cleaning frame 51, i.e., is integrally formed with the cleaning frame 51.

The frame body 55 has a box-like shape formed with an opening facing forward and includes a bottom wall 55A.

The light-guide support part 56 is disposed adjacent to and forward of the bottom wall 55A of the frame body 55. The front edge of the bottom wall 55A of the frame body 55 is connected to the light-guide support part 56.

The light-guide support part 56 has a reflective part 60, a side plate part 61 shown in FIG. 4, a bottom plate part 62, and a ridge 63.

The reflective part 60 constitutes the rear part of the light-guide support part 56. The reflective part 60 has a plate shape that is generally rectangular in a front view and elongated in the left-right direction. The reflective part 60 is flat along the top-bottom direction. The front edge of the bottom wall 55A is connected to the rear surface of the reflective part 60 at the approximate vertical center region of the reflective part 60.

As shown in FIG. 4, the bottom plate part 62 constitutes the bottom part of the light-guide support part 56. The bottom plate part 62 has a plate shape that is substantially rectangular in a bottom view and elongated in the left-right direction. As shown in FIGS. 2 and 4, the bottom plate part 62 extends forward from the bottom edge of the reflective part 60. Specifically, the bottom plate part 62 includes five protruding parts 62A protruding forward from the reflective part 60 and a bridge portion 62B extending in the left-right direction. The bridge portion 62B is provided on the protruding parts 62A and separated from the reflective part 60 in the front-rear direction, as shown in FIG. 2, thereby supporting the light guide 7 from below.

As shown in FIG. 4, the side plate part 61 constitutes the left end of the light-guide support part 56. The side plate part 61 has a plate shape that is substantially rectangular in a side view and extends forward from the left edge of the reflective part 60. Further, the bottom edge of the side plate part 61 is connected to the left edge of the bottom plate part 62. With this configuration, the side plate part 61 closes the left end of the light-guide support part 56. Note that the right end of the light-guide support part 56 is open.

As shown in FIG. 2, the ridge 63 has a general rectangular shape in a side view and protrudes forward from the top edge of the reflective part 60. The ridge 63 extends along the entire left-right dimension of the reflective part 60.

Configured in this way, the reflective part 60, the bottom plate part 62, and the ridge 63 form a general U-shape in a side view, with the opening of the "U" facing the drum body 40.

The cleaning roller 6 is disposed immediately above the light-guide support part 56. The rear portion of the cleaning roller 6 is disposed within the frame body 55 and the front portion of the cleaning roller 6 is exposed outside the frame body 55.

The cleaning roller 6 has a general columnar shape whose axis extends in the left-right direction. The cleaning roller 6 is supported on the cleaning frame 51, i.e., the left and right ends of the cleaning roller 6 is rotatably supported on the left and right side walls of the frame body 55. The lower front surface of the cleaning roller 6 is in rolling contact with the upper rear surface of the photosensitive drum 3.

The collecting roller 52 is disposed inside the frame body 55 and at the upper rear side of the cleaning roller 6. The collecting roller 52 has a general columnar shape whose axis extends in the left-right direction. The collecting roller 52 is rotatably supported on the cleaning frame 51, i.e., the left and right ends of the collecting roller 52 is rotatably supported on the left and right side walls of the frame body 55. The lower front surface of the collecting roller 52 is in rolling contact with the upper rear surface of the cleaning roller 6.

The sponge scraper 54 is disposed inside the frame body 55 and is interposed between the top wall of the frame body 55 and the collecting roller 52. The sponge scraper 54 is fixed to the bottom surface of the top wall of the frame body 55. The bottom surface of the sponge scraper 54 is in sliding contact with the upper surface of the collecting roller 52.

As shown in FIG. 7B, the cleaning electrodes 53 are configured to supply external bias to the cleaning unit 50. The cleaning electrodes 53 include a first electrode 53A, and a second electrode 53B. That is, the cleaning electrode 53 is configured to receive the external bias from outside of the drum cartridge 1.

The first and second electrodes 53A and 53B are both formed of a conductive resin material, for example, and are disposed in the rear portion of the right side frame wall 30 so as to be exposed from the right side of the side frame wall 30 through the corresponding electrode-exposing holes 46. That is, the cleaning electrodes 53 are positioned rightward (an example of the first side) of the image-forming region T1 on the drum body 40, as shown in FIGS. 7B and 8.

While not shown in the drawings, the first electrode 53A is electrically connected to the right end of the cleaning roller 6, and the second electrode 53B is electrically connected to the right end of the collecting roller 52.

As shown in FIG. 2, the film member 57 is disposed between the cleaning roller 6 and the light-guide support part 56 in the top-bottom direction. The film member 57 is formed of a publicly known resin film and has a general rectangular shape in a plan view elongated in the left-right direction. The film member 57 is supported on the light-guide support part 56 by fixing the rear edge of the film member 57 to the top surface of the ridge 63. With this configuration, the film member 57 protrudes toward the drum body 40 from the reflective part 60. That is, the film member 57 protrudes farther forward than a second part 71 of the light guide 7 described later.

During the image-forming operation described above, the cleaning unit 50 having this configuration removes and collects paper dust and other extraneous matter deposited on the drum body 40 after a charge-eliminating operation described later has been performed. The cleaning operation of the cleaning unit 50 will be described next.

In the cleaning operation performed by the cleaning unit 50, the first and second electrodes 53A and 53B receive bias from a device-side circuit board (not shown) provided in the device body 12 via device-side electrodes (not shown). Consequently, the bias is applied to the cleaning roller 6 through the first electrode 53A, charging the cleaning roller 6 with a higher positive polarity than the surface potential of the drum body 40. Further, the bias is applied to the collecting roller 52 through the second electrode 53B, charging the collecting roller 52 with a higher positive polarity than the cleaning roller 6.

As shown in FIG. 2, the cleaning roller 6 collects any deposited paper dust from the circumferential surface of the drum body 40. In other words, the cleaning roller 6 removes any extraneous matter deposited on the surface of the photosensitive drum 3. The paper dust collected on the cleaning roller 6 is subsequently attracted to the collecting roller 52. Next, the sponge scraper 54 scrapes off the paper dust from the collecting roller 52, and the paper dust is collected in the frame body 55.

(4) Light Guide

The light guide 7 is supported by the light-guide support part 56 at a position beneath the cleaning roller 6 and rearward of the drum body 40.

The light guide 7 is formed of a transparent and colorless acrylic resin, for example. As shown in FIG. 5B, the light guide 7 is configured of a rod-like member formed in a general L-shape in cross-section. The light guide 7 has a first part 70, a second part 71, and a light-path converting surface 72 as an example of the third part.

The first part 70 constitutes the right end of the light guide 7. As shown in FIG. 7A, the first part 70 has a general columnar shape and extends in a direction from the upper front to the lower rear. The first part 70 also has one end provided with an incident surface 70A and another end connected to the second part 71.

The incident surface 70A constitutes the lower rear endface of the first part 70. The incident surface 70A is a flat surface orthogonal to a first direction X extending from the upper front to the lower rear and from the lower rear to the upper front, as depicted by arrow in FIG. 7A.

Figure 5A:
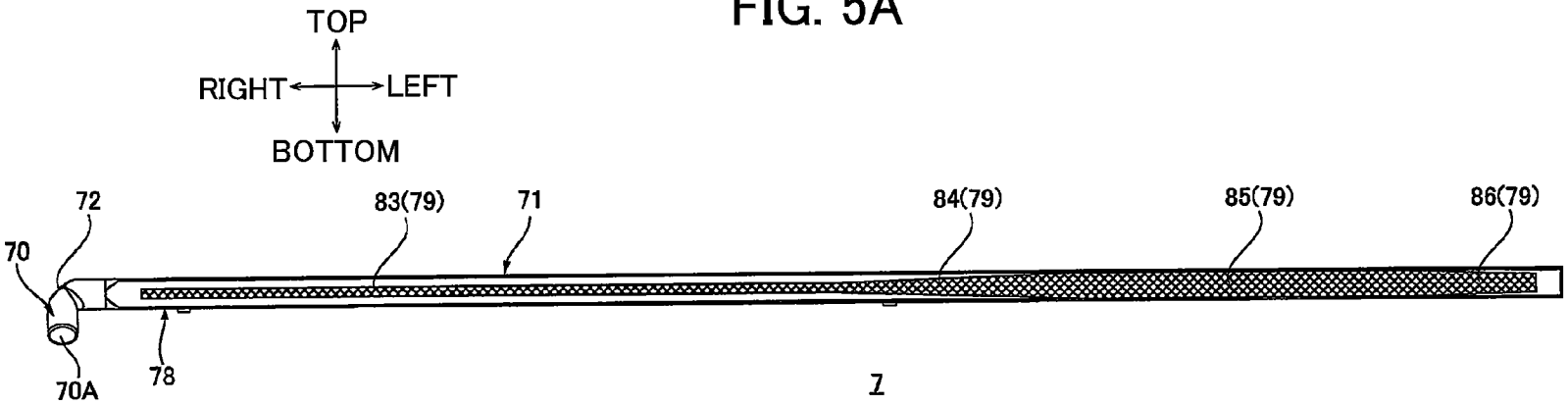
FIG. 5A is a rear view of the light guide according to the first embodiment.
Figure 5B:
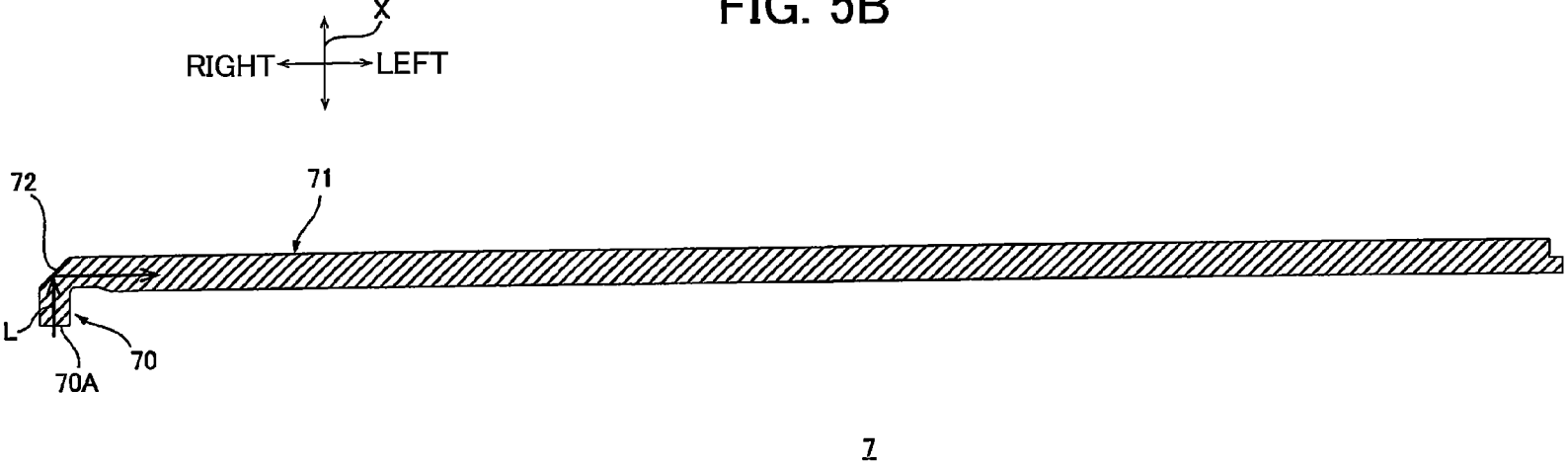
FIG. 5B is a cross-sectional view of the light guide according to the first embodiment.

As shown in FIG. 5A, the second part 71 has a rod-like shape extending in the left-right direction. At least part of the second part 71 is accommodated in the light-guide support part 56. The right end of the second part 71 is connected to the other end of the first part 70. Hence, the first part 70 and the second part 71 are arranged substantially orthogonal to each other. The second part 71 has a left-right dimension greater than the left-right dimension of the light-guide support part 56 and a vertical dimension approximately the same as the vertical gap formed between the bottom plate part 62 and the ridge 63 of the light-guide support part 56, as shown in FIG. 2.

More specifically, the second part 71 is configured of an arc surface 75 as an example of the passing part, a top surface 76, a bottom surface 77, and a back surface 78 as an example of the back part.

The arc surface 75 constitutes the front surface of the second part 71. The arc surface 75 is a curved surface that has a general semicircular arc shape in a side view. The convex side of the arc surface 75 protrudes forward, i.e., toward the drum body 40. The top surface 76 constitutes the top surface of the second part 71 and is a flat surface extending continuously rearward from the top edge of the arc surface 75. The bottom surface 77 constitutes the bottom surface of the second part 71 and is a flat surface extending continuously rearward from the bottom edge of the are surface 75.

The back surface 78 constitutes the rear surface of the second part 71 and extends vertically and connects the rear edge of the top surface 76 with the rear edge of the bottom surface 77. As shown in FIGS. 5A and 8, the back surface 78 is a flat surface having a surface-roughened part 79.

The surface-roughened part 79 is provided in the approximate vertical center of the back surface 78. The surface-roughened part 79 is recessed forward from the back surface 78. This recessed portion is roughened to form tiny irregularities (a pearskin finish) and may be formed through a surface texturing process (etching process), for example. Cross-hatching is depicted in FIG. 5A to distinguish the surface-roughened part 79 from the surrounding portion of the back surface 78.

The surface-roughened part 79 extends in the left-right direction and has a left-right dimension approximately nine-tenths of the left-right dimension of the back surface 78, for example. More specifically, the surface-roughened part 79 includes a narrowest part 83, a gradually-widening part 84 as an example of the widening part, a widest part 85, and a gradually-narrowing part 86 as an example of the narrowing part.

The narrowest part 83 constitutes the right portion of the surface-roughened part 79 and extends leftward from the right edge of the surface-roughened part 79 to the approximate left-right center of the surface-roughened part 79. Thus, the left-right dimension of the narrowest part 83 is approximately one-half of the left-right dimension of the surface-roughened part 79. The vertical dimension of the narrowest part 83 is approximately one-third of the vertical dimension of the back surface 78, for example. The vertical dimension of the narrowest part 83 is uniform across the entire left-right dimension thereof. The right edge of the narrowest part 83, i.e., the right edge of the surface-roughened part 79, is separated leftward from the right end of the second part 71.

The gradually-widening part 84 extends continuously leftward from the left end of the narrowest part 83. The vertical dimension of the gradually-widening part 84 gradually increases toward the left. That is, the vertical dimension of the gradually-widening part 84 gradually increases from right to left. The left-right dimension of the gradually-widening part 84 is approximately one-seventh of the left-right dimension of the back surface 78.

The widest part 85 extends continuously leftward from the left end of the gradually-widening part 84. The left-right dimension of the widest part 85 is approximately one-fourth of the left-right dimension of the back surface 78. The vertical dimension of the widest part 85 is approximately nine-tenths of the vertical dimension of the back surface 78, for example, and is uniform across the entire left-right dimension of the widest part 85.

The gradually-narrowing part 86 constitutes the left portion of the surface-roughened part 79 and extends continuously leftward from the left end of the widest part 85. The vertical dimension of the gradually-narrowing part 86 gradually decreases toward the left. Thus, the gradually-narrowing part 86 is opposite to the gradually-widening part 84 with respect to the widest part 85 in the left-right direction, i.e., the narrowest part 83, the gradually-widening part 84, the widest part 85, and the gradually-narrowing part 86 are arranged in this order from right to left. The vertical dimension of the gradually-narrowing part 86 gradually narrows from right to left. The left-right dimension of the gradually-narrowing part 86 is approximately one-tenth of the left-right dimension of the surface-roughened part 79. The left end of the gradually-narrowing part 86, i.e., the left end of the surface-roughened part 79, is separated rightward from the left end of the second part 71.

The surface-roughened part 79 faces the image-forming region T1 in the front-rear direction as shown in FIG. 8, i.e., the surface-roughened part 79 is overlapped with the image-forming region T1 in a front view, in order to entirely and uniformly irradiate light L emitted from the light source 90 over the image-forming region T1 of the drum body 40.

Further, the surface roughness of the surface-roughened part 79 is uniform across the left-right dimension. Note that the surface roughness of the surface-roughened part 79 may be measured using a contact-type surface roughness tester or the like known in the art.

As shown in FIG. 5B, the light-path converting surface 72 is disposed in the region at which the first part 70 connects to the second part 71. The light-path converting surface 72 is formed by cutting the right end of the connecting portion between the first part 70 and the second part 71 at an approximate 45-degree slope relative to the left-right direction. Hence, the light-path converting surface 72 is a sloped surface that is disposed between the first part 70 and the second part 71 and that is sloped relative to the second part 71. Specifically, the light-path converting surface 72 is angled approximately 45 degrees relative to the left-right direction.

As shown in FIG. 4, the light-path converting surface 72 has an elliptical shape elongated in the left-right direction as viewed from the first direction X. As shown in FIG. 5B, the left-right dimension of the light-path converting surface 72 is approximately equal to the left-right dimension of the first part 70, while the front-rear dimension of the light-path converting surface 72 is approximately equal to the front-rear dimension of the second part 71. Accordingly, the light-path converting surface 72 is positioned to be aligned with the first part 70 as viewed from the first direction X and to be aligned with the second part 71 as viewed from the left-right direction.

As shown in FIG. 4, the light guide 7 is supported in the cleaning frame 51 immediately below the cleaning roller 6 by accommodating the second part 71 in the light-guide support part 56.

More specifically, the left end of the light guide 7 is in contact with the right surface on the side plate part 61 of the light-guide support part 56, the bottom surface 77 of the light guide 7 is in contact with the top surface of the bottom plate part 62, and the back surface 78 of the light guide 7 is in contact with the front surface of the reflective part 60. As shown in FIG. 2, the top surface 76 of the light guide 7 is disposed beneath the film member 57 but separated therefrom. Thus, the film member 57 covers the top surface 76 of the light guide 7 from above.

As shown in FIGS. 2 and 8, the second part 71 confronts the image-forming region T1 of the drum body 40 from the rear side and is slightly separated therefrom. Hence, the arc surface 75 of the second part 71 protrudes toward the drum body 40 and faces the image-forming region T1 of the drum body 40. In other words, the back surface 78 of the light guide 7 is provided opposite to the drum body 40 with respect to the arc surface 75, while the reflective part 60 of the light-guide support part 56 is provided opposite to the drum body 40 with respect to the back surface 78. That is, the drum body 40, the arc surface 75, the back surface 78, and the reflective part 60 are arranged in this order from front to rear.

As shown in FIG. 4, the first part 70 and the light-path converting surface 72 are positioned farther rightward than the right end of the light-guide support part 56. As shown in FIG. 8, the first part 70 and the light-path converting surface 72 are separated from but adjacent to the rear side of the right non-image-forming region T2 of the drum body 40. In other words, the first part 70 and the light-path converting surface 72 are positioned farther rightward (an example of a first side) than the image-forming region T1 of the drum body 40.

As shown in FIG. 7A, the first part 70 and the light-path converting surface 72 are disposed in the cleaner accommodating section 35 at a position separated from the upper front side of the sloped section 36B in the first direction X. Hence, the light guide 7 is accommodated in the cleaner accommodating section 35. The incident surface 70A of the first part 70 faces the opening 37 in the sloped section 36B in the first direction X.

4. Detailed Description of the Device Body

As shown in FIG. 3, the device body 12 includes the light source 90 configured to emit the light L.

As shown in FIG. 7B, the light source 90 is disposed in the device body 12 so as to be positioned diagonally downward and rearward of the right end of the lower rear edge of the drum cartridge 1 when the drum cartridge 1 is mounted in the device body 12.

As shown in FIGS. 7A and 7B, the light source 90 includes a light-emitting unit 92, a seat part 93, and an insertion part 94.

The seat part 93 constitutes the lower rear portion of the light source 90. The seat part 93 has a general triangular columnar shape and is elongated in the left-right direction. Specifically, the bottom surface of the seat part 93 extends in the front-rear direction. The upper front surface of the seat part 93 continuously extends diagonally upward and rearward from the front edge of the bottom surface of the seat part 93. The upper rear surface of the seat part 93 continuously extends diagonally downward and rearward from the top edge of the upper front surface of the seat part 93.

The left-right dimension of the seat part 93 is greater than the gap between the pair of ribs 38 in the left-right direction.

The insertion part 94 constitutes the upper front portion of the light source 90 and is disposed on the upper front surface of the seat part 93. In a side view, the insertion part 94 has a box-like shape. i.e., a general rectangular shape. Specifically, the insertion part 94 protrudes from the upper front surface of the seat part 93 in a direction diagonally from the lower rear to the upper front. The left-right dimension of the insertion part 94 is smaller than the left-right dimension of the seat part 93.

As shown in FIG. 7A, the insertion part 94 is formed with an insertion hole 95. The insertion hole 95 has a general circular shape as viewed from the first direction X and penetrates the upper front wall of the insertion part 94 in the first direction X.

The light-emitting unit 92 is accommodated in the insertion part 94. The light-emitting unit 92 includes a substrate part 96, a cylindrical part 97, the light-emitting element 98, and the lens part 99.

The substrate part 96 has a general plate shape elongated in a direction extending diagonally from the lower front to the upper rear in a side view. The substrate part 96 is electrically connected to a device-side substrate (not shown). The cylindrical part 97 has a general cylindrical shape elongated in the first direction X. The cylindrical part 97 is disposed on the upper front surface of the substrate part 96.

The light-emitting element 98 is fixed to the substrate part 96 in the cylindrical part 97. The light-emitting element 98 is configured of an LED light provided with an LED, for example. The light-emitting element 98 is electrically connected to the substrate part 96 and is configured to emit the light L toward the upper front.

The lens part 99 is disposed inside the cylindrical part 97 on the upper front side of the light-emitting element 98 and supported on the cylindrical part 97. The lens part 99 is a convex lens that protrudes diagonally upward and forward, for example.

The light-emitting unit 92 is accommodated in the insertion part 94 such that the upper front end portion of the cylindrical part 97 is inserted in the insertion hole 95.

When the drum cartridge 1 is mounted in the device body 12, the light source 90 having the above configuration is positioned adjacent to the lower rear side of the sloped section 36B of the accommodating section bottom wall 36. Specifically, when the drum cartridge 1 is mounted in the device body 12, the light-emitting element 98, the lens part 99, the opening 37, the incident surface 70A, and the light-path converting part 72 are arranged in this order from the lower bottom to the upper front.

As shown in FIG. 7B, the insertion part 94 of the light source 90 is inserted between the pair of ribs 38 in the left-right direction. As a result, the insertion hole 95 of the insertion part 94 is disposed on the lower rear side of the opening 37 formed in the sloped section 36B, and the light-emitting element 98 confronts but is separated from the incident surface 70A of the first part 70 in the first direction X, as shown in FIG. 7A.

While not shown in the drawings, a drive source is provided on the inner left wall of the device body 12, while a device-side circuit board and device-side electrodes are provided on the right wall of the device body 12.

5. Static-Eliminating Operation

Charge may remain on the circumferential surface of the drum body 40 of the photosensitive drum 3 after a toner image is transferred from the photosensitive drum 3 to a sheet P during the image-forming operation described above. Therefore, the printer 11 of the first embodiment performs the charge-eliminating operation to remove residual charge from the surface of the photosensitive drum 3.

In the charge-eliminating operation for the photosensitive drum 3, a substrate (not shown) supplies power to the light source 90, and the light-emitting element 98 of the light source 90 emits the light L toward the upper front for neutralizing charge on the photosensitive drum 3, as shown in FIG. 7A. The light L emitted from the light-emitting element 98 passes through the lens part 99 and the opening 37 formed in the sloped section 36B, and then enters the first part 70 through the incident surface 70A.

The light L entering the first part 70 advances diagonally upward and forward in the first part 70 in the first direction X until arriving at the light-path converting surface 72, as shown in FIG. 5B.

The light-path converting surface 72 reflects the light L which has been passing through the first part 70 at an angle of approximately 90 degrees, changing the advancing direction of the light L from diagonally upward and forward direction to leftward direction. In this way, the light L is allowed to pass through the first part toward the second part 71, i.e., the light L passing through the first part 70 is guided toward the second part 71. The light L reflected on the light-path converting surface 72 advances through the second part 71 in the leftward direction.

As the light L passes through the second part 71, the surface-roughened part 79 of the back surface 78 reflects part of the light L forward toward the arc surface 75, as shown in FIG. 2.

Further, the reflective part 60 reflects remaining light L leaked through the surface-roughened part 79 forward toward the second part 71. The remaining light L reflected on the reflective part 60 includes light that passes rearward through the surface-roughened part 79 and light that passes rearward through portions of the back surface 78 outside the surface-roughened part 79.

Hence, the light L reflected by the surface-roughened part 79 and the reflective part 60 advances forward and passes through the arc surface 75 to be irradiated on the surface of the photosensitive drum 3. Light irradiated on the photosensitive drum 3 in this way removes any residual charge from the circumferential surface of the drum body 40.

6. Operational Advantages (1) As shown in FIG. 5B, the first part 70 of the light guide 7 guides the light L emitted from the light source 90 in the first direction X, and the light-path converting surface 72 of the light guide 7 changes the advancing direction of the light L to allow the light L which has been passing through the first part 70 to be directed to the second part 71. Thereafter, the second part 71 of the light guide 7 guides the light L traveling therein to the surface of the photosensitive drum 3, as shown in FIG. 2. The light L irradiated on the surface of the photosensitive drum 3 in this way removes any residual charge from the surface of the photosensitive drum 3.

As shown in FIGS. 7A and 8, by arranging the first part 70 of the light guide 7 and the light source 90 to be aligned in the first direction X, orthogonal to the left-right direction, these components can remove charge from the surface of the photosensitive drum 3. Hence, since it is unnecessary to align the light guide 7 and the light source 90 in the left-right direction, the left-right dimension of the printer 11 can be made more compact.

(2) As shown in FIG. 5B, the first part 70 and the second part 71 are substantially orthogonal to each other. Accordingly, since the first part 70 and the light source 90 are arranged to be aligned in a direction orthogonal to the left-right direction, as shown in FIG. 7A, the left-right dimension of the printer 11 can reliably be made more compact.

(3) As shown in FIG. 8, the first part 70 and the light-path converting surface 72 are arranged outside the image-forming region T1 in the left-right direction. This arrangement reduces the possibility of the first part 70 and the second part 71 interfering with formation of electrostatic latent images to be formed on the image-forming region T1.

(4) As shown in FIG. 5B, the light-path converting surface 72 is sloped at an angle of approximately 45 degrees to the left-right direction. Accordingly, the light-path converting surface 72 can reliably change the advancing direction of the light L passing through the first part 70 to a direction toward the second part 71.

(5) As shown in FIGS. 2 and 5A, the second part 71 has the arc surface 75 and the back surface 78. As shown in FIG. 2, the surface-roughened part 79 of the back surface 78 reflects light L passing through the second part 71 toward the photosensitive drum 3. The reflected light L passes through the arc surface 75 and then is irradiated on the surface of the photosensitive drum 3. Thus, this construction reliably guides the light L emitted from the light source 90 toward the surface of the photosensitive drum 3.

(6) As shown in FIG. 2, the arc surface 75 is a curved surface that protrudes toward the photosensitive drum 3. Accordingly, the light L passing through the arc surface 75 from the interior of the second part 71 is refracted uniformly by the arc surface 75, enabling the light L to be irradiated uniformly over the surface of the photosensitive drum 3.

(7) Since the back surface 78 is a flat surface, the surface-roughened part 79 formed at the back surface 78 can reliably reflect the light L in the second part 71 toward the photosensitive drum 3. Further, since the back surface 78 and the reflective part 60 are both flat, the surface of the reflective part 60 can be in surface contact with the surface of the back surface 78. This construction can reduce the amount of light leaking from the back surface 78 and can improve the efficiency of the light L irradiated from the arc surface 75.

(8) As shown in FIG. 5A, the surface-roughened part 79 has the gradually-widening part 84 and the gradually-narrowing part 86. This configuration can more suitably adjust the amount of light reflected by the surface-roughened part 79 over the left-right dimension thereof.

(9) As shown in FIG. 2, the reflective part 60 is disposed opposite to the photosensitive drum 3 with respect to the back surface 78. Accordingly, the reflective part 60 can reflect part of the light L that passes through and is leaked through the surface-roughened part 79 of the light guide 7 toward the interior of the light guide 7. This configuration suppresses part of the light L from passing through parts of the second part 71 other than the arc surface 75, thereby increasing the amount of the light L irradiated from the second part 71 onto the surface of the photosensitive drum 3.

(10) As shown in FIG. 2, the film member 57 covers the top of the second part 71. Accordingly, the film member 57 can reliably restrain the light L from passing through portions of the second part 71 other than the arc surface 75. Further, since the film member 57 is disposed vertically between the cleaning roller 6 and the second part 71, the film member 57 can avoid paper dust and the like falling from the drum body 40 and the cleaning roller 6 during the cleaning operation described above from contaminating the second part 71 of the light guide 7.

(11) As shown in FIG. 2, the light-guide support part 56 is opaque and has a color configured to reflect the light L. Accordingly, the reflective part 60 of the light-guide support part 56 can reliably reflect the light L passing through the back surface 78 back to the light guide 7.

(12) As shown in FIG. 2, the drum cartridge 1 is provided with the cleaning roller 6 for removing paper dust and other extraneous matter deposited on the surface of the photosensitive drum 3. Further, since the light-guide support part 56 is part of the cleaning frame 51, the second part 71 of the light guide 7 is accommodated in part of the cleaning frame 51. The cleaning roller 6 needs to be positioned adjacent to the photosensitive drum 3 in order to remove extraneous matter deposited on the surface of the photosensitive drum 3, and the second part 71 of the light guide 7 needs to be positioned adjacent to the photosensitive drum 3 in order to remove charge from the photosensitive drum 3. In the first embodiment, both the cleaning roller 6 and the second part 71 of the light guide 7 can be reliably arranged adjacent to the photosensitive drum 3, ensuring an efficient layout for the cleaning roller 6 and the second part 71.

(13) As shown in FIG. 4, the light-path converting surface 72 is positioned rightward of the cleaning frame 51. Hence, the light-path converting surface 72 can change the advancing direction of the light L passing through the first part 70 at a position rightward of the cleaning frame 51, enabling a more flexible layout of the first part 70.

(14) As shown in FIG. 2, the cleaning frame 51 is disposed inside the drum frame 2. This arrangement can improve the precision in positioning the photosensitive drum 3 accommodated in the drum frame 2 relative to the cleaning roller 6 and the second part 71 of the light guide 7 supported in the cleaning frame 51.

Further, the light-path converting surface 72 of the light guide 7 is disposed inside the drum frame 2, as shown in FIG. 7A. Accordingly, the interior space of the drum frame 2 can be effectively utilized to ensure an efficient arrangement of the light-path converting surface 72.

(15) As shown in FIG. 8, the first part 70 of the light guide 7 is disposed rightward of the image-forming region T1 of the drum body 40, and the left flange part 41L formed with the engaging recess 42 is disposed leftward of the image-forming region T1. Accordingly, the first part 70 can be positioned opposite to the left flange part 41L with respect to the image-forming region T1 in the left-right direction, achieving better balance in the left-right direction for the layout of the first part 70 and the left flange part 41L.

Further, since the drive source (not shown) is provided on the inner left wall of the device body 12, the left flange part 41L formed with the engaging recess 42 can be arranged in proximity to this drive source. Accordingly, the structure for transmitting a drive force from the drive source to the left flange part 41L can be made compact.

(16) As shown in FIGS. 7A, 7B, and 8, the cleaning electrodes 53 and the first part 70 are arranged to the right of the image-forming region T1 on the drum body 40. This arrangement improves the precision in positioning the cleaning electrodes 53 and the first part 70 relative to each other.

Thus, the configuration of the first embodiment can improve the precision in positioning the cleaning electrodes 53 relative to the device-side electrodes (not shown) and the precision in positioning the first part 70 relative to the light source 90. Accordingly, the cleaning electrodes 53 can reliably receive bias from the device-side electrodes, and the first part 70 can reliably receive the light L from the light source 90.

Further, a circuit board (not shown) is provided on the inner right wall of the device body 12 for supplying power to the cleaning electrodes 53 and the light source 90. Hence, by arranging the cleaning electrodes 53 and the first part 70 rightward of the image-forming region T1, the cleaning electrodes 53 and the light source 90 can be arranged in proximity to the circuit board. This arrangement enables a simplification of the structure for transmitting power from the circuit board to the cleaning electrodes 53 and the light source 90.

7. Second Embodiment

Next, a second embodiment will be described with reference to FIGS. 10 through 12B, wherein like parts and components are designated with the same reference numerals to avoid duplicating description.

Figure 10:
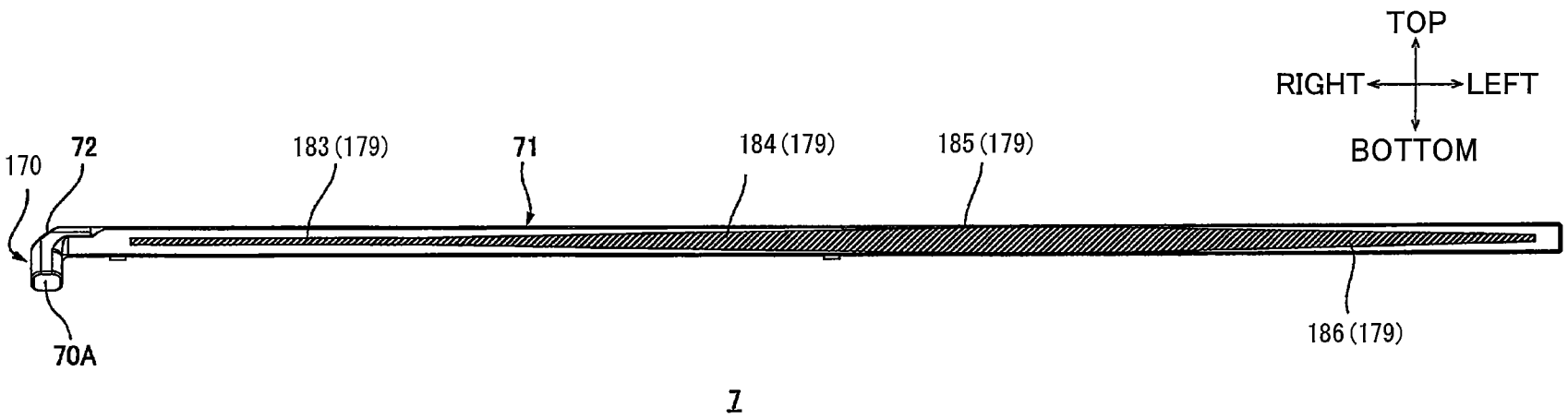
FIG. 10 is a rear view of a light guide of a drum cartridge according to a second embodiment of the disclosure.

As shown in FIG. 10, the light guide 7 includes a first part 170 having a general square columnar shape extending in the first direction X.

Figure 11:
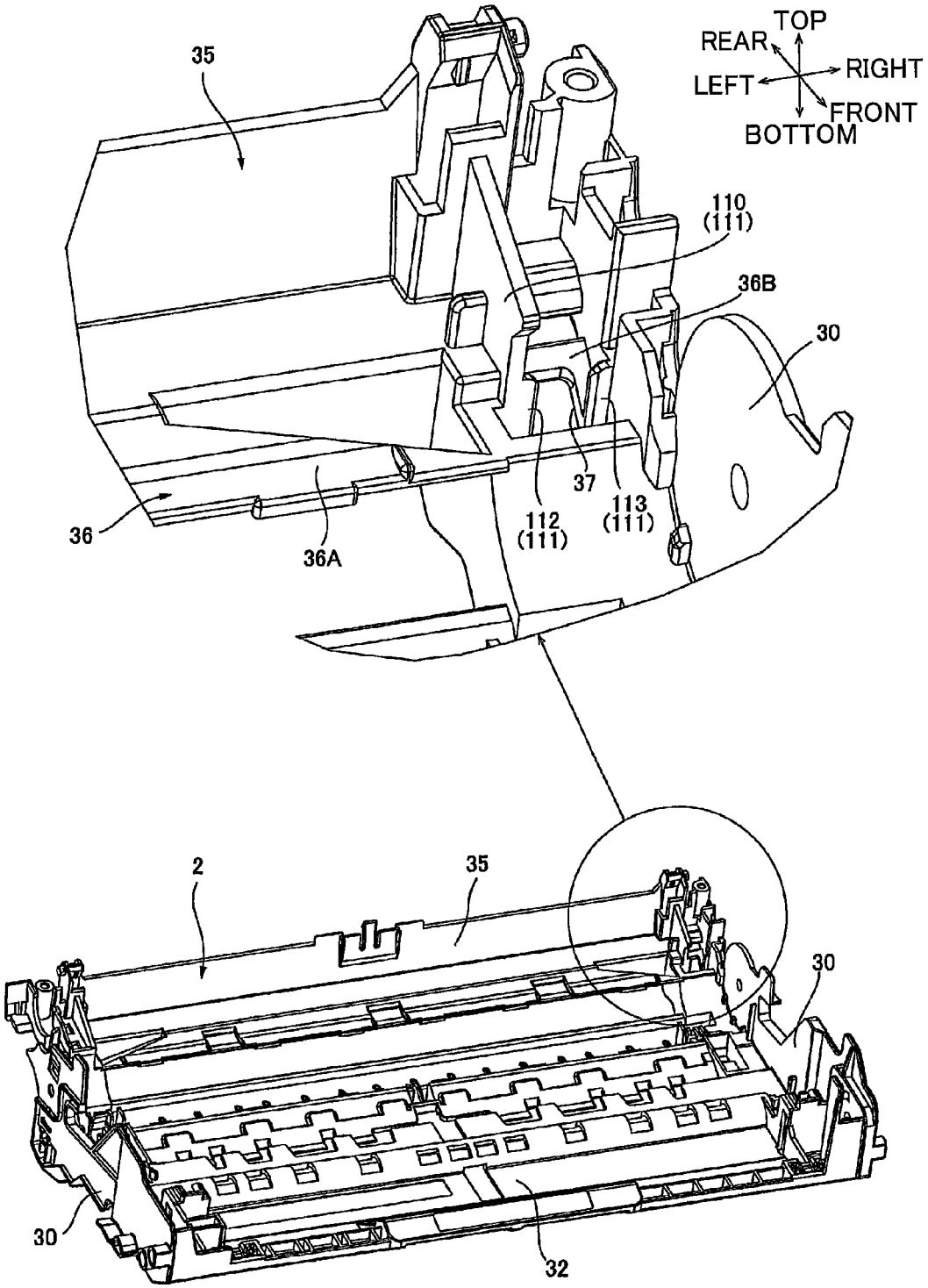
FIG. 11 is a perspective view of a drum frame of the drum cartridge as viewed from diagonally upper left according to the second embodiment.
Figure 12A:
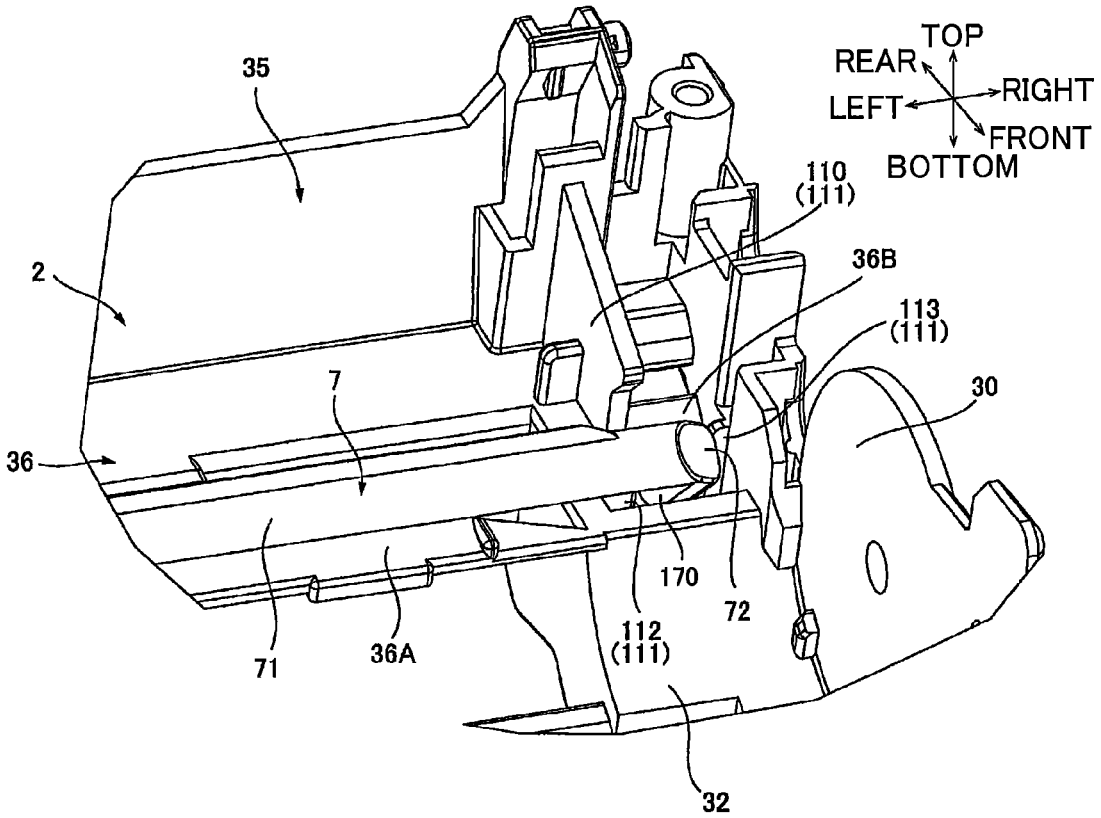
FIG. 12A is a perspective view of the drum frame in which the light guide is accommodated as viewed from upper left according to the second embodiment.
Figure 12B:
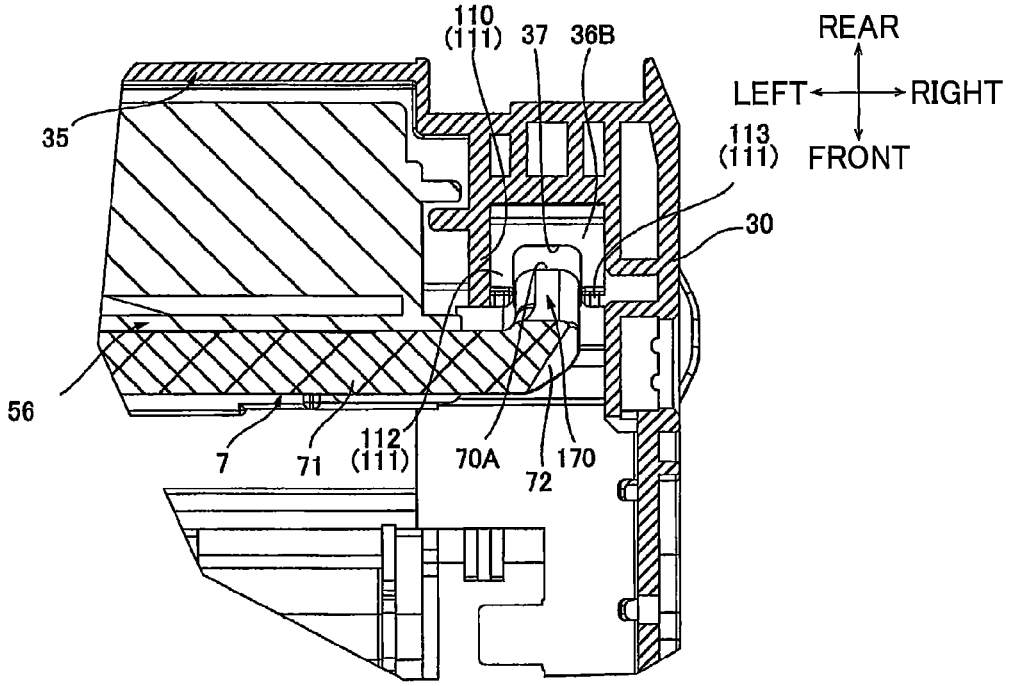
FIG. 12B is a cross-sectional view of the light guide and an engaging portion according to the second embodiment.

As shown in FIG. 12B, the drum frame 2 of the second embodiment is provided with an engaging unit 111 configured to engage the first part 170 of the light guide 7. More specifically, the engaging unit 111 as an example of an engaging part is provided on the cleaner accommodating section 35, as shown in FIG. 11, and specifically is disposed on the right end of the cleaner accommodating section 35. The engaging unit 111 includes a wall part 110, a first engaging rib 112 as an example of the first engaging part, and a second engaging rib 113 as an example of the second engaging part.

The wall part 110 faces the right side frame wall 30 but is separated therefrom and is positioned leftward of the right side frame wall 30. The wall part 110 has a plate shape that is generally rectangular in a side view and extends upward from the left edge on the top surface of the sloped section 36B.

The first engaging rib 112 is disposed on the front edge of the right surface of the wall part 110. The first engaging rib 112 has a general rectangular shape in a front view and is elongated vertically. The first engaging rib 112 protrudes rightward from the wall part 110. The bottom edge of the first engaging rib 112 is connected to the sloped section 36B.

The second engaging rib 113 is disposed on the left surface of the right side frame wall 30. The second engaging rib 113 is positioned rightward of the first engaging rib 112 so as to confront but be separated from the first engaging rib 112. Hence, the first engaging rib 112 and the second engaging rib 113 are separated from each other in the left-right direction. The second engaging rib 113 has a general rectangular shape in a front view and is elongated vertically. The second engaging rib 113 protrudes leftward from the right side frame wall 30. The bottom edge of the second engaging rib 113 is connected to the sloped section 36B. As shown in FIG. 12A, the left-right dimension of the first part 170 is approximately equal to the left-right distance between the first engaging rib 112 and the second engaging rib 113.

As shown in FIG. 10, the back surface 78 is formed with a surface-roughened part 179 whose shape is different from the surface-roughened part 79 of the first embodiment. Specifically, the surface-roughened part 179 includes a narrowest part 183, a gradually-widening part 184 as an example of the widening part, a widest part 185, and a gradually-narrowing part 186 as an example of the narrowing part. The left-right dimension of the narrowest part 183 is smaller than that of the narrowest part 83 of the first embodiment. The left-right dimension of the gradually-widening part 184 is greater than that of the gradually-widening part 84 of the first embodiment. The left-right dimension of the widest part 185 is substantially the same as that of the widest part 85 of the first embodiment. The left-right dimension of the gradually-narrowing part 186 is greater than that of the gradually-narrowing part 186 of the first embodiment. That is, the vertical dimension of the left end of the gradually-narrowing part 186 is smaller than that that of the gradually-narrowing part 86. The shape of the surface-roughened part 179 in a side view may be modified so that the light L reflected by the surface-roughened part 179 is effectively concentrated on the arc surface 75.

As shown in FIG. 12B, the first part 170 of the light guide 7 is inserted between the first engaging rib 112 and the second engaging rib 113 in the left-right direction when the light guide 7 is accommodated in the cleaner accommodating section 35 such that the incident surface 70A confronts the opening 37 formed in the sloped section 36B. Hence, the first part 170 of the light guide 7 is interposed between the first engaging rib 112 and the second engaging rib 113 in the left-right direction.

As shown in FIG. 12B, the drum frame 2 according to the second embodiment described above is provided with the opening 37 and the engaging unit 111, and the engaging unit 111 engages with the first part 170 of the light guide 7. Hence, this arrangement can improve the precision in positioning the first part 170 of the light guide 7 relative to the opening 37. Accordingly, light irradiated from the light source 90 can reliably enter the first part 170 through the opening 37.

Further, the first part 170 of the light guide 7 is interposed between the first engaging rib 112 and the second engaging rib 113 provided on the left and right sides of the first part 170. Hence, this configuration further improves the precision in positioning the first part 170 of the light guide 7 relative to the opening 37 in the left-right direction.

The second embodiment described above can obtain the same operational advantages described above in the first embodiment.

Figure 9A:
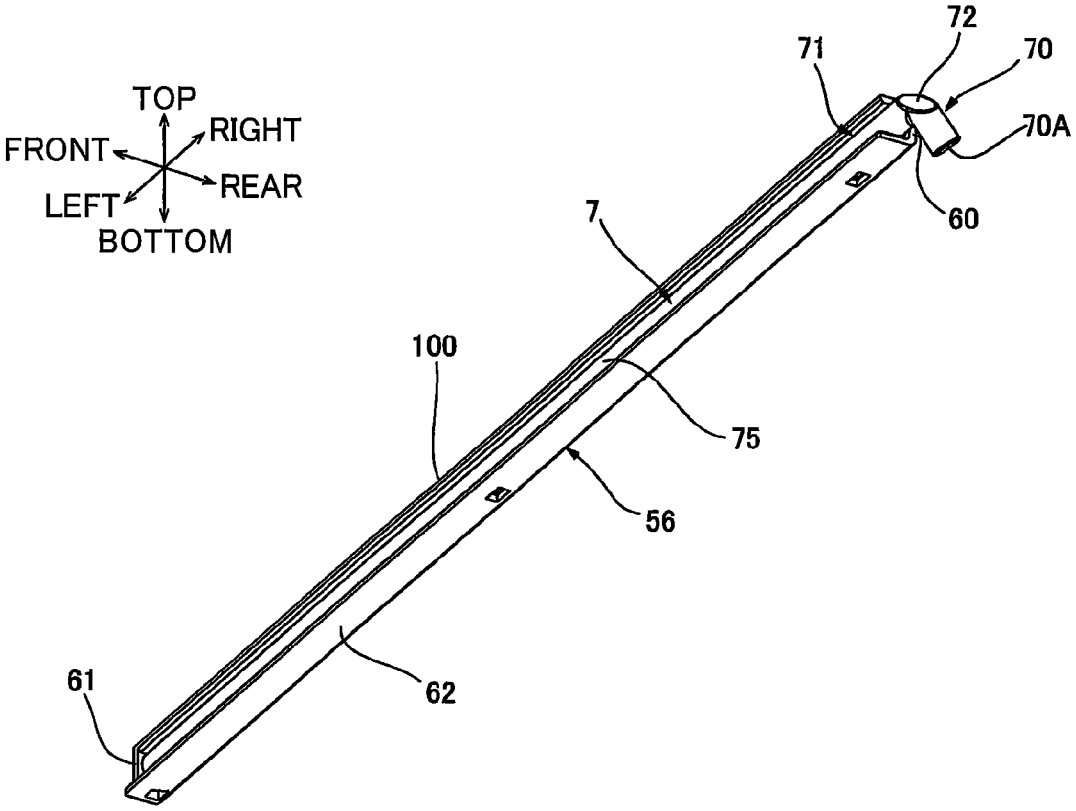
FIG. 9A is a perspective view of a light guide and a light guide cover as viewed from diagonally lower front according to a modification of the present disclosure.
Figure 9B:
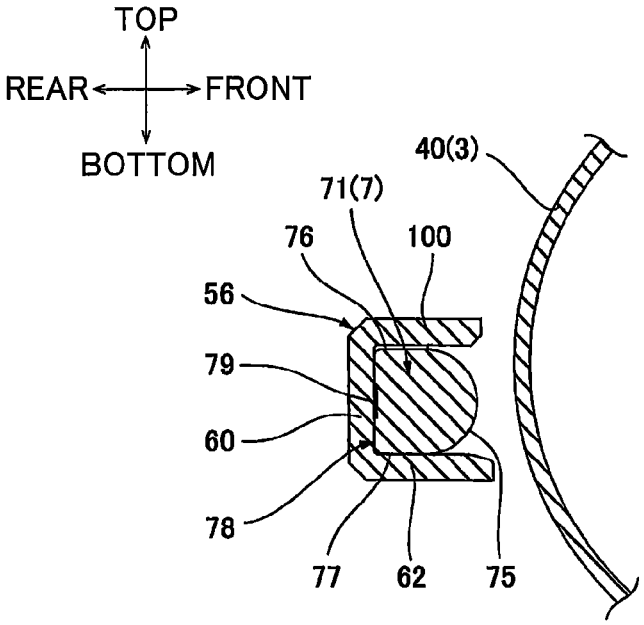
FIG. 9B is a central cross-sectional view of the light guide and the light guide cover according to the modification.

8. Variations of the Embodiments (1) As shown in FIG. 2, the film member 57 in the first embodiment described above is disposed above the light guide 7 and covers the top surface 76 of the light guide 7, but the light-guide support part 56 may be integrally provided with a top part 100 as an example of the cover part, as shown in FIGS. 9A and 9B. That is, the top part 100 is integrally formed with the reflective part 60 and the bottom plate part 62.

The top part 100 protrudes forward from the top edge of the reflective part 60 toward the drum body 40. The left edge of the top part 100 is connected to the top edge of the side plate part 61. The top part 100 covers the top surface 76 and the arc surface 75 of the second part 71 from above. With this configuration, the light-guide support part 56 has a general U-shape in a side view, with the opening of the "U" facing forward. The top surface 76 of the light guide 7 is covered by the top part 100.

(2) As shown in FIG. 2, the light guide 7 of the first embodiment described above is disposed upstream of the cleaning roller 6 in the rotating direction of the drum body 40. However, the position of the light guide 7 is not limited to this configuration, provided that the light guide 7 is downstream of the transfer roller 4 and upstream of the scorotron charger 5 in the rotating direction of the drum body 40.

For example, the light guide 7 can be disposed downstream of the cleaning roller 6 and upstream of the scorotron charger 5 in the rotating direction of the drum body 40. In this case, the light guide 7 performs the charge-eliminating operation described above for eliminating residual charge from the drum body 40 after the cleaning roller 6 has removed deposited matter from the circumferential surface of the drum body 40.

(3) In the first embodiment described above, the process cartridge 13 is configured of the drum cartridge 1, and the developing cartridge 20 detachably mounted in the drum cartridge 1. However, the process cartridge 13 may be integrally configured of the drum cartridge 1 and the developing cartridge 20. In this case, the process cartridge 13 serves as an example of the photosensitive cartridge. Further, the toner accommodating section 24 is integrally provided in the developing cartridge 20 in the first embodiment. However, the toner accommodating section 24 may be removably provided in the developing cartridge 20 as a toner cartridge configured to accommodate toner therein.

(4) In the first embodiment described above, the surface roughness of the surface-roughened part 79 is uniform in the left-right direction, as shown in FIG. 5A, but this surface roughness may be varied in the left-right direction.

For example, the widest part 85 of the surface-roughened part 79 may be given the highest surface roughness and the narrowest part 83 may be given the lowest roughness. This configuration can more precisely adjust the amount of light reflected by the surface-roughened part 79 in the left-right direction.

Note that the vertical dimension of the surface-roughened part 79 may be kept uniform in the left-right direction when the surface roughness of the surface-roughened part 79 is varied in the left-right direction. This configuration can suitably adjust the quantity of light reflected by the surface-roughened part 79 in the left-right direction.

(5) In the second embodiment described above, the engaging unit 111 is provided with the wall part 110, the first engaging rib 112, and the second engaging rib 113, as shown in FIG. 11. However, the structure of the engaging unit 111 has no particular limitation, provided that the engaging unit 111 can engage the first part 170 of the light guide 7. For example, the engaging unit 111 may be a cylindrical member that protrudes diagonally upward and forward from the sloped section 36B around the periphery of the opening 37. In this case, the first part 170 of the light guide 7 is inserted into the engaging unit 111.

Any of these variations can obtain the same operational advantages described above in the first and second embodiments. Note that the first and second embodiments and their variations described above may also be combined when appropriate.

What is claimed is:

1. A photosensitive cartridge removably mounted in an image forming device having a light source, the photosensitive cartridge comprising:

a photosensitive drum having a surface on which an electrostatic latent image is configured to be formed, the photosensitive drum extending in an axial direction;

a drum frame accommodating the photosensitive drum therein, the drum frame having a pair of side walls facing and spaced apart from each other in the axial direction, each of the axial ends of the photosensitive drum being supported at each of the pair of side walls; and a guide member configured to guide light emitted from the light source toward the surface of the photosensitive drum to neutralize charge on the surface of the photosensitive drum, the guide member comprising:

a first part configured to receive the light emitted from the light source, the first part extending in a direction crossing the axial direction;

a second part facing the photosensitive drum and extending in the axial direction; and a third part connecting the first part and the second part and configured to allow the light to pass through the first part toward the second part, the drum frame accommodating the guide member such that the first and the third part are positioned inward of the pair of side walls in the axial direction.

2. The photosensitive cartridge according to claim 1, wherein the third part has a sloped surface sloped relative to the second part.

3. The photosensitive cartridge according to claim 1, wherein the first part is orthogonal to the second part.

4. The photosensitive cartridge according to claim 1, wherein the surface of the photosensitive drum has an image-forming region on which the electrostatic latent image is configured to be carried;

wherein the first part and the third part are positioned outside the image-forming region in the axial direction.

5. The photosensitive cartridge according to claim 1, wherein the third part has a sloped surface angled generally 45 degrees relative to the axial direction.

6. The photosensitive cartridge according to claim 5, wherein the sloped surface is configured to change an advancing direction of the light.

7. The photosensitive cartridge according to claim 1, wherein the second part comprises:

a passing part facing the surface of the photosensitive drum, the light in the second part passing through the passing part; and a back part comprising a surface-roughened part configured to reflect the light in the second part toward the passing part, the back part being positioned opposite to the photosensitive drum with respect to the passing part.

8. The photosensitive cartridge according to claim 7, wherein the passing part protrudes toward the photosensitive drum.

9. The photosensitive cartridge according to claim 7, wherein the back part extends in a flat shape.

10. The photosensitive cartridge according to claim 7, wherein the surface-roughened part comprising:

a widening part extending in the axial direction and having one end and another end in the axial direction, the widening part having a width in an orthogonal direction orthogonal to the axial direction, the width being gradually increased in a direction from the one end to the another end; and a narrowing part extending in alignment with the widening part and having a first end adjacent to the another end and a second end away from the another end in the axial direction, the narrowing part having a width in the orthogonal direction, the width of the narrowing part being gradually decreased in a direction from the first end to the second end.

11. The photosensitive cartridge according to claim 7, wherein the surface-roughened part has a surface roughness which is varied in the axial direction.

12. The photosensitive cartridge according to claim 7, further comprising a reflective part positioned opposite to the photosensitive drum with respect to the back part, the reflective part being configured to reflect the light which has been leaked through the surface-roughened part toward the guide member.

13. The photosensitive cartridge according to claim 12, further comprising:

a cover comprising the reflective part and accommodating at least part of the second part, the cover being formed with an opening open to the photosensitive drum; and a covering portion protruding from the reflective part toward the photosensitive drum so as to cover the second part.

14. The photosensitive cartridge according to claim 13, wherein the cover is formed of an opaque and has a color configured to reflect the light.

15. The photosensitive cartridge according to claim 13, further comprising:

a cleaning member configured to remove extraneous matter deposited on the surface of the photosensitive drum; and a cleaning frame supporting the cleaning member, the cover being a part of the cleaning frame.

16. The photosensitive cartridge according to claim 15, wherein the third part is positioned outside the cleaning frame in the axial direction.

17. The photosensitive cartridge according to claim 15, wherein the cleaning frame is disposed within the drum frame.

18. The photosensitive cartridge according to claim 1, wherein the surface of the photosensitive drum has an image-forming region on which the electrostatic latent image is configured to be carried, the image-forming region having a first end at a first side and a second end at a second side opposite to the first side in the axial direction, wherein the first part is disposed at the first side;

wherein the photosensitive drum comprises a drive receiving part configured to receive an external drive force, the drive receiving part being disposed at the second side.

19. The photosensitive cartridge according to claim 1, further comprising an electrode member configured to receive an external bias, wherein the surface of the photosensitive drum has an image-forming region on which the electrostatic latent image is configured to be carried, the image-forming region having a first end at the first side and a second end at a second side opposite to the first side in the axial direction, the electrode member and the first part being disposed at the first side.

20. The photosensitive cartridge according to claim 1, wherein the drum frame is formed with an opening in alignment with the first part in the axial direction, the drum frame comprising an engaging part engaging the first part.

21. The photosensitive cartridge according to claim 20, wherein the engaging part comprises a first engaging part and a second engaging part separated from the first engaging part in the axial direction, the first part being sandwiched between the first engaging part and the second engaging part in the axial direction.

* * * * *